US012416462B2

(12) United States Patent
Kloepfer et al.

(10) Patent No.: US 12,416,462 B2
(45) Date of Patent: Sep. 16, 2025

(54) ELECTROMECHANICAL TRIGGER AND METHODS OF OPERATING A GUN USING THE SAME

(71) Applicant: Biofire Technologies Inc., Broomfield, CO (US)

(72) Inventors: Kai Thorin Kloepfer, Denver, CO (US); Donna Kelley, Louisville, CO (US); Sara Elizabeth Falcone, Lafayette, CO (US); Katherine Joanne Lund, Westminster, CO (US); Jack Hugo Thiesen, Firestone, CO (US); Joseph Ray Wilding, Castle Rock, CO (US); Benjamin William Dwyer, Golden, CO (US); John Andrew Tomasik, Golden, CO (US)

(73) Assignee: Biofire Technologies Inc., Broomfield, CO (US)

( * ) Notice: Subject to any disclaimer, the term of this patent is extended or adjusted under 35 U.S.C. 154(b) by 281 days.

(21) Appl. No.: 18/066,075

(22) Filed: Dec. 14, 2022

(65) Prior Publication Data

US 2023/0113679 A1 Apr. 13, 2023

Related U.S. Application Data

(63) Continuation of application No. 17/655,530, filed on Mar. 18, 2022, now Pat. No. 11,555,663.

(Continued)

(51) Int. Cl.
*F41A 19/59* (2006.01)
*F41A 17/56* (2006.01)

(52) U.S. Cl.
CPC ..... *F41A 19/59* (2013.01); *F41A 17/56* (2013.01)

(58) Field of Classification Search
CPC ..... F41A 19/59
See application file for complete search history.

(56) References Cited

U.S. PATENT DOCUMENTS 2,337,145 A 12/1943 Norman
3,334,208 A 8/1967 Green
(Continued)

FOREIGN PATENT DOCUMENTS

BE 902696 A 12/1985
CA 3218275 A1 * 5/2024 ..... A63F 13/245
(Continued)

OTHER PUBLICATIONS

"International Search Report and Written Opinion" mailed on Jul. 26, 2022 for PCT Application No. PCT/US2022/071231, 42 pages.

*Primary Examiner* — Gabriel J. Klein
(74) *Attorney, Agent, or Firm* — Perkins Coie LLP; Andrew T. Pettit

(57) ABSTRACT

The present disclosure provides systems and techniques for an electromechanical trigger that is implementable in a gun. The gun may include a trigger mechanism, a trigger sensing mechanism, and a fire control manager. The fire control manager may identify a trigger break based on the trigger sensing mechanism generating a voltage, and the fire control manager may transmit a signal to an actuator mechanism based on the trigger break. A detent mechanism may be dislocated in response to a force applied to a trigger mechanism, and the trigger sensing mechanism may generate the voltage based on the dislocating of the detent mechanism. Dislocating the detent mechanism may correspond to satisfying a trigger break threshold. The actuator mechanism may be displaced in response to the signal, and displacing the actuator mechanism may result in a projectile being propelled from the gun.

13 Claims, 14 Drawing Sheets

Related U.S. Application Data

(60) Provisional application No. 63/176,770, filed on Apr. 19, 2021.

(56) References Cited

U.S. PATENT DOCUMENTS

| | | | | |
|---|---|---|---|---|
| 3,546,803 | A * | 12/1970 | Swanson | F41A 3/12 42/16 |
| 3,888,021 | A | 6/1975 | McCurdy | |
| 4,009,536 | A | 3/1977 | Wolff | |
| 4,275,521 | A | 6/1981 | Gerstenberger et al. | |
| 4,347,679 | A | 9/1982 | Gruenig et al. | |
| 4,793,085 | A | 12/1988 | Surawski et al. | |
| 5,386,659 | A | 2/1995 | Vaid et al. | |
| 6,321,478 | B1 | 11/2001 | Klebes | |
| 6,425,199 | B1 | 7/2002 | Vaid et al. | |
| 6,802,305 | B1 | 10/2004 | Hatcher | |
| 10,240,881 | B1 | 3/2019 | Galie et al. | |
| 2003/0221684 | A1 | 12/2003 | Rice | |
| 2006/0107578 | A1 | 5/2006 | Danner et al. | |
| 2010/0186277 | A1 | 7/2010 | Beckmann | |
| 2011/0139139 | A1 | 6/2011 | Knuth et al. | |
| 2011/0271574 | A1 | 11/2011 | Chang et al. | |
| 2013/0112183 | A1 | 5/2013 | Arnedo | |
| 2015/0332077 | A1 | 11/2015 | Wilz et al. | |
| 2016/0061549 | A1 | 3/2016 | Patterson et al. | |
| 2016/0084601 | A1 | 3/2016 | Alicea | |
| 2017/0102200 | A1 | 4/2017 | Alicea | |
| 2019/0011207 | A1 | 1/2019 | Al-Mutawa | |
| 2019/0041151 | A1 | 2/2019 | Folk et al. | |

FOREIGN PATENT DOCUMENTS

| | | | |
|---|---|---|---|
| DE | 102013102313 | A1 | 9/2014 |
| DE | 102016109695 | B4 | 4/2018 |
| EP | 0081130 | A2 | 6/1983 |
| EP | 0991026 | A2 | 4/2000 |
| FR | 2764685 | A1 | 12/1998 |
| GB | 2510889 | A | 8/2014 |
| KR | 101441715 | B1 | 9/2014 |
| WO | 0036358 | A2 | 6/2000 |
| WO | WO 2002/079717 | A2 | 10/2002 |

* cited by examiner

100

200

300

400

700

800

1000

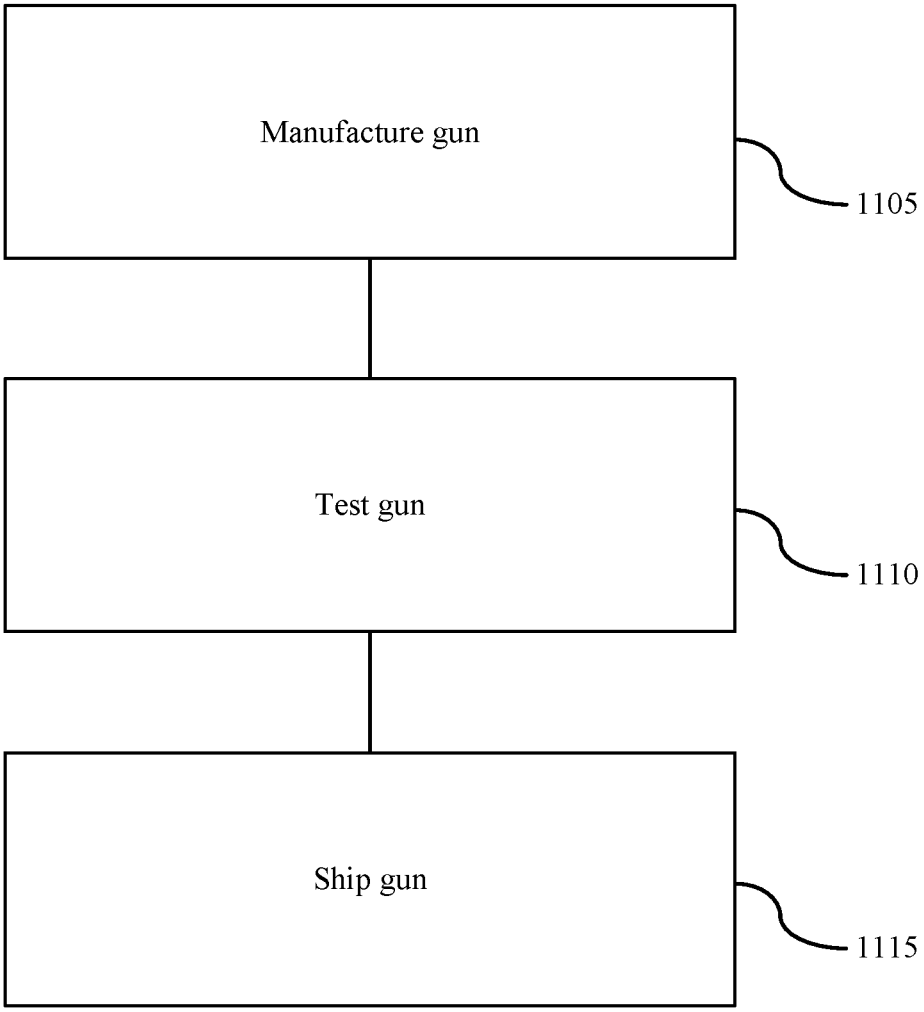
FIG. 11
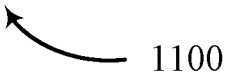

1300

ELECTROMECHANICAL TRIGGER AND METHODS OF OPERATING A GUN USING THE SAME

CROSS-REFERENCE TO RELATED APPLICATIONS

This application is a continuation of U.S. patent application Ser. No. 17/655,530, titled "ELECTROMECHANICAL TRIGGER AND METHODS OF OPERATING A GUN USING THE SAME" and filed Mar. 18, 2022, which claims priority to U.S. Provisional Application No. 63/176,770, titled "ELECTROMECHANICAL TRIGGER" and filed on Apr. 19, 2021, which are incorporated by reference herein in their entireties.

FIELD OF TECHNOLOGY

The teachings disclosed herein generally relate to guns, and more specifically to an electromechanical trigger.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and dispose guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems, apparatuses, and techniques described herein support an electromechanical trigger that is implementable in a gun. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the described systems and techniques described herein provide a trigger system implementable in guns. The gun may include a trigger mechanism, a trigger sensing mechanism, and a fire control manager. A detent mechanism may be dislocated in response to a force applied to the trigger mechanism, and the trigger sensing mechanism may generate a voltage based on the dislocating of the detent mechanism. Dislocating the detent mechanism may indicate or otherwise correspond to the satisfying of a trigger break threshold. The fire control manager may identify a trigger break and transmit a signal to an actuator mechanism. The fire control manager may transmit the signal to the actuator mechanism in response to identifying the dislocating of the detent mechanism and identifying the trigger break. The actuator mechanism may be displaced in response to the signal, and displacing the actuator mechanism may result in a projectile being propelled from the gun.

BRIEF DESCRIPTION OF THE DRAWINGS

FIG. 11 illustrates an example of a flowchart that supports an electromechanical trigger in accordance with aspects of the present disclosure.

Figure 1:
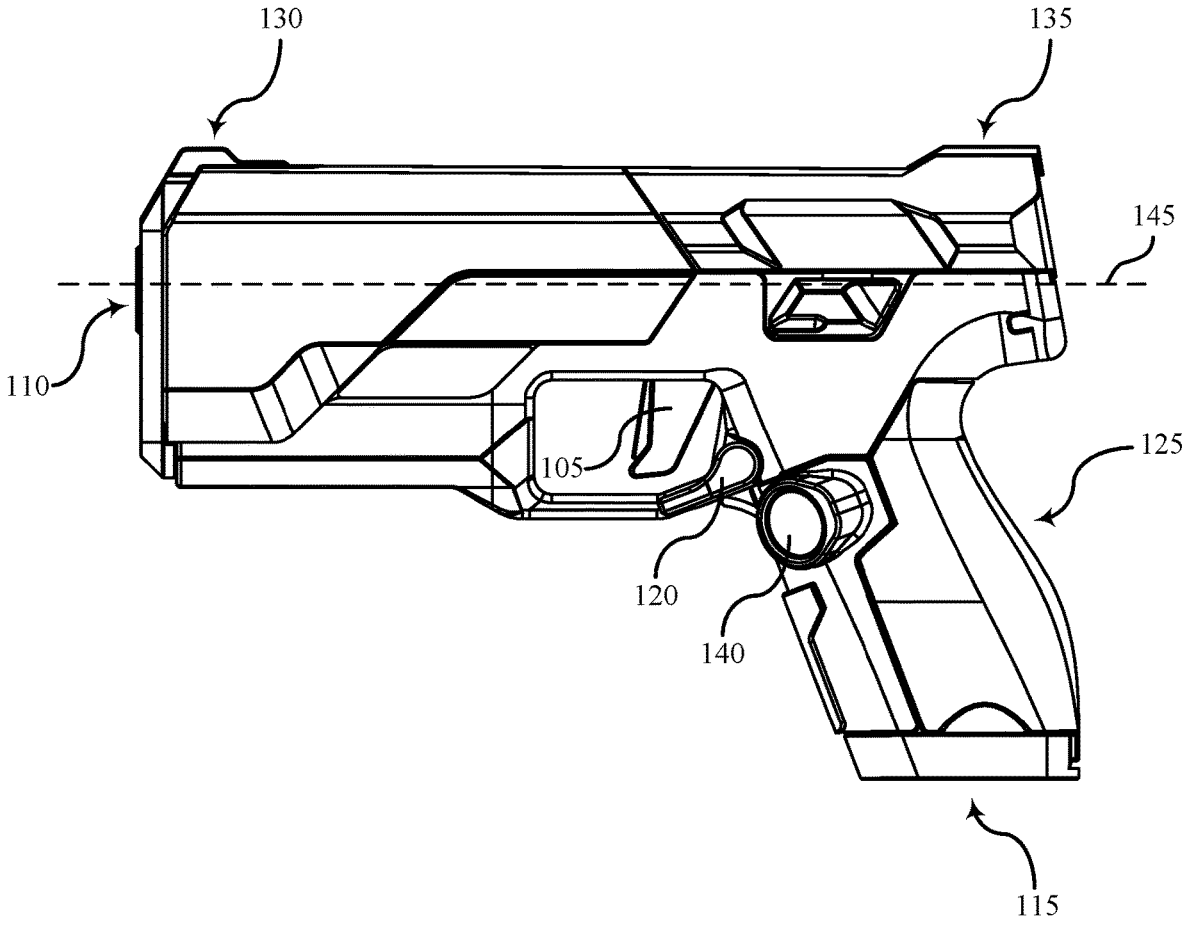
FIG. 1 illustrates an example of a gun that supports an electromechanical trigger in accordance with aspects of the present disclosure.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

In conventional guns, the trigger is mechanically connected to the sear, providing the shooter with the ability to move the sear and release the striker or hammer by pulling the trigger. The mechanical connection between the trigger and sear also produces a trigger with a characteristic feel that is largely the result of the sear releasing the striker or hammer. For example, a trigger bar is often used to connect the trigger to the sear such that pulling the trigger results in movement of the sear, and sufficient movement of the sear allows the release of the striker or hammer, causing the firing pin to collide with the cartridge primer, ignite the propellant, and propel a projectile from the gun.

A trigger system allows the shooter (also referred to as a "user") to operate the gun. In conventional guns, the trigger system provides a mechanical connection between the trigger and the sear, thereby allowing the shooting to move the sear and release the striker or hammer by pulling the trigger, but this type of connection imposes significant constraints on the trigger weight and feel. For example, a user may desire a light trigger weight, but conventional guns that deliver a light trigger weight often have a precarious connection between the sear and striker or hammer, making the gun susceptible to accidental discharges. Additionally, trigger systems often include safety features, but when the trigger is mechanically connected to the sear, significant constraints are imposed on the types of safety features that may be used. For example, a drop safety may be used to prevent the sear from unintentionally dropping and releasing the striker or hammer, but a shooter may damage or incorrectly install the drop safety, thereby resulting in a gun that is prone to accidental discharges.

Some conventional guns include an inhibitor mechanism to attempt to deliver improved safety. But trigger inhibition mechanisms—namely, mechanisms that inhibit movement of the trigger while the gun is unarmed and allows movement of the trigger while the gun is armed—can often be defeated by simply removing the inhibitor mechanism from the gun. For example, a gun may include a bar that inhibits (or simply blocks) movement of the trigger while the gun is unarmed, and a holding current may be used to hold the bar in a different location such that the trigger is not inhibited by the bar, allowing the gun can function as normal while the gun is armed. If a thief steals the gun and removes the inhibitor bar that is used to inhibit movement of the trigger, then the gun loses the safety benefits originally provided by the inhibitor mechanism.

Some conventional guns include an inhibitor mechanism that is disengaged in response to authenticating the shooter. For example, an inhibitor rod may obstruct the trigger while no shooter is authenticated, and the inhibitor rod may be displaced in response to authenticating the shooter such that the trigger is not obstructed by the inhibitor rod. As with the drop safety, such inhibitor mechanisms can be damaged or removed from the gun, yielding a gun that may be used by anybody and/or prone to accidental discharges.

Introduced here, therefore, is an electromechanical trigger for guns that provides a familiar and adjustable trigger feel with enhanced safety features. The electromechanical trigger described herein can be used in electrical firing systems and remove the direct mechanical connection between the trigger and the sear, thereby improving the safety of the system and increasing the adjustability of the trigger. The electromechanical trigger described herein includes a detent mechanism (e.g., a mechanical detent, an electromagnetic detent, etc.) that produces a trigger feel that is both familiar and adjustable. The electromechanical trigger described herein produces a trigger break that can be identified with a trigger sensing mechanism (e.g., a Hall effect sensor, an optical sensor, a physical switch, etc.). The gun may include both mechanical safeties and electrical safeties to enhance the safety of the gun. For example, the gun may include a mechanical trigger safety and an electrically activated drop safety.

The gun may include an actuator mechanism that facilitates the firing of a projectile from the gun in response to a user pulling the trigger. For example, the actuator mechanism may release a sear, a striker, or a hammer in response to the trigger sensing mechanism identifying a trigger beak, and the gun may propel a projectile through the barrel based on the actuator mechanism releasing sear, striker, or hammer. In another example, the actuator mechanism may transmit an electrical signal to an electrically activated round of ammunition in response to the trigger sensing mechanism identifying the trigger beak, and the electrical signal may ignite a propellant and cause the round of ammunition to be accelerated through the barrel and propelled from the gun at high velocity. In some examples, the actuator mechanism may act as a safety that is electrically disengaged in response to identifying the trigger break such that the gun may be fired. The actuator mechanism may be activated in response to identifying the trigger break and determining that an authorized user is holding the gun, and the gun may fire a projectile based on activating the actuator mechanism. An actuator mechanism may facilitate the control of a fire control component, such as a sear, a striker, a hammer, or a firing pin and/or a safety component, such as a firing pin safety, a drop safety, or a trigger safety. An actuator mechanism may include an actuator block, a plunger, a spring, a solenoid-based actuator, a piezoelectric-based actuator, or the like. The electromechanical trigger described herein improves gun safety, as the gun may utilize the actuator mechanism to fire a projectile in response to identifying a trigger break and determining that an authorized user is holding the gun, so unauthorized users may fail to fire the gun. Additionally, since a direct mechanical connection may not exist between the trigger and sear, simply removing the actuator mechanism or the safety mechanisms from the gun may render the gun non-operational, thereby thwarting unauthorized users from operating the gun by simply removing component from the gun.

The detent mechanism may be implemented as a mechanical detent or an electromagnetic detent. For example, the detent mechanism may include a spring-loaded ball detent, a firing pin safety with a coil spring, a leaf spring, a pneumatic valve, a magnet, or the like. The detent mechanism may support the shooter in modifying the trigger weight and feel. For example, the detent mechanism may include a spring, and the shooter may adjust the spring orientation or compression to alter the trigger weight. As another example, the detent mechanism may include multiple magnets, and the shooter may adjust the location of the magnets to alter the trigger weight.

The trigger sensing mechanism may be implemented as an electromagnetic sensor, an optical sensor, or a physical switch. For example, the trigger sensing mechanism may include a Hall effect sensor that generates a voltage based on movement of the trigger mechanism. The trigger sensing mechanism may be used to identify movement of the trigger mechanism satisfying a trigger break threshold. The trigger break threshold may include a force threshold, a distance threshold, or both. As an illustrative example, the trigger mechanism may include a magnet, and a Hall effect sensor may be positioned to identify movement of the trigger mechanism based on the magnet. The Hall effect sensor may be positioned such that a voltage is generated by the Hall effect sensor based on the magnet being within a threshold distance of the Hall effect sensor. In other words, the voltage may be generated based on the trigger mechanism moving the magnet close to the Hall effect sensor. A fire control manager may identify the voltage and activate the actuator mechanism (e.g., by transmitting an electrical signal), where activating the actuator mechanism results in the gun firing a projectile.

The trigger mechanism may include a trigger body, a trigger bar, or a connector, and the trigger sensing mechanism may identify movement of the trigger body, the trigger bar, or the connector. As an illustrative example, a magnet may be coupled with the trigger body, and a Hall effect sensor may be positioned on an interior edge of the frame of the gun such that the Hall effect sensor generates a voltage in response to the trigger body moving and the magnet being located within a threshold distance of the Hall effect sensor. The electromechanical trigger may be configured such that the magnet is located within the threshold distance of the Hall effect sensor when the trigger mechanism dislocates the detent mechanism. As such, the trigger break may be identified based on the trigger mechanism dislocating the detent mechanism, and the actuator mechanism may be activated in response to the trigger break being identified, causing the gun fire a projectile.

The systems and techniques described herein can be used in the context of trigger systems that include actuator mechanisms, inhibitor mechanisms, or both. A gun including an electromechanical trigger may disengage an inhibitor mechanism based on movement of the trigger mechanism, and the gun may fire a projectile based on the inhibitor mechanism being disengaged. A gun including an electromechanical trigger may activate an actuator mechanism to displace the sear based on movement of the trigger mechanism such that a striker or hammer is released, causing the gun to fire a projectile. The electromechanical trigger described herein supports identifying a trigger break and activating an actuator mechanism and/or disengaging an inhibitor mechanism to facilitate the firing of a projectile from the gun. The systems and techniques described herein improve gun safety while delivering a trigger feel that is both familiar and adjustable.

Embodiments may be described in the context of executable instructions for the purpose of illustration. For example, a fire control manager housed in a gun may be described as being capable of implementing logic, processing signals, or executing instructions that permit the identifying of a trigger break and firing of the gun. For example, the fire control manager may identify a trigger break based on a Hall effect sensor, transmit an electrical signal to disengage an inhibitor mechanism, and transmit an electrical signal to activate an actuator mechanism and release the sear. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that supports an electromechanical sear in accordance with aspects of the present disclosure. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and improve the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint sensor (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may support various types of aiming sights (or simply "sights"). At a high level, a sight is an aiming device that may be used to assist in visually align the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights-namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The gun 100 may include a trigger mechanism including the trigger 105. The gun 100 may also include a trigger sensing mechanism and a fire control manager. The fire control manager may identify a trigger break based on the trigger sensing mechanism generating a voltage, and the fire control manager may transmit a signal to an actuator mechanism based on the trigger break. A detent mechanism may be dislocated in response to a force applied to the trigger 105, and the trigger sensing mechanism may generate the voltage based on the dislocating of the detent mechanism. Dislocating the detent mechanism may correspond to satisfying a trigger break threshold. The actuator mechanism may be displaced in response to the signal, and displacing the actuator mechanism may result in a projectile being propelled from the barrel 110.

Figure 2:
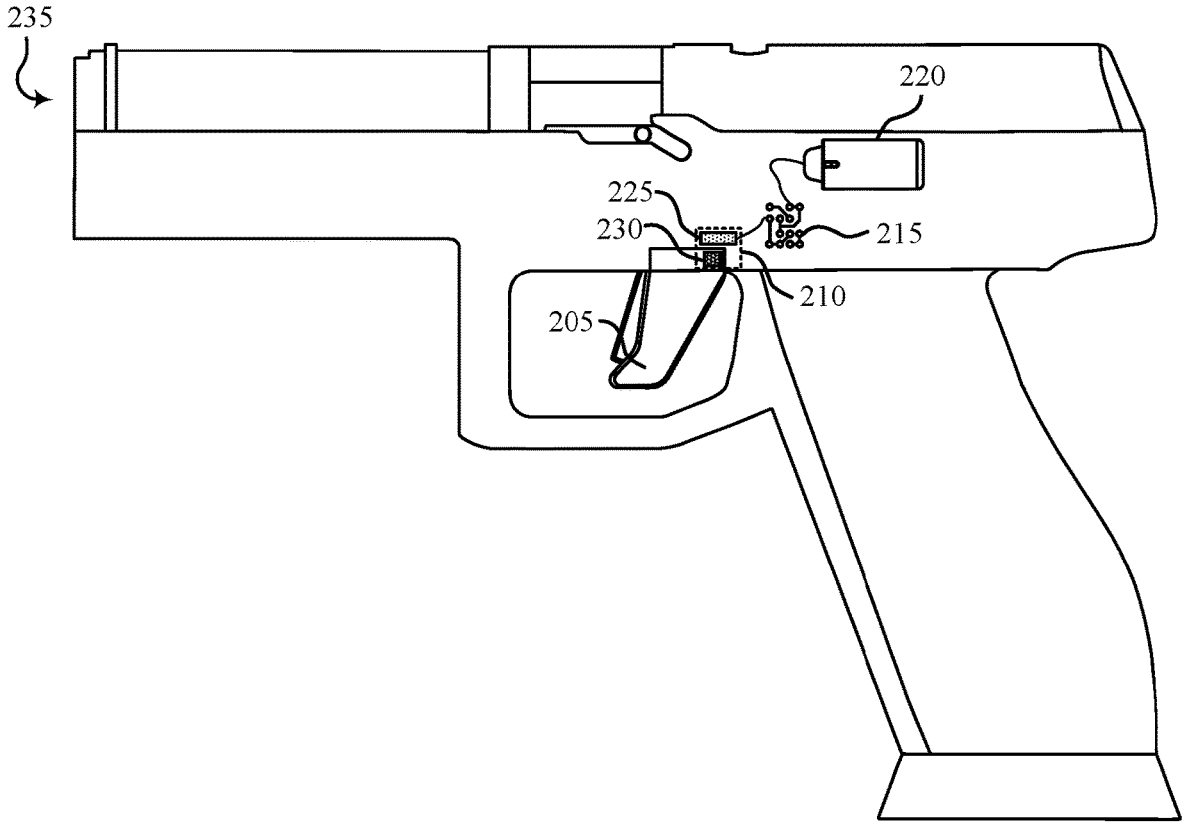
FIG. 2 illustrates an example of a gun that supports an electromechanical trigger in accordance with aspects of the present disclosure.

FIG. 2 illustrates an example of a gun 200 that supports an electromechanical trigger in accordance with aspects of the present disclosure. The gun 200 may be an example of the gun 100 as described with reference to FIG. 1.

The gun 200 includes a trigger 205, a trigger sensing mechanism 210, a fire control manager 215, and an actuator mechanism 220. In response to a user pulling the trigger 205, the fire control manager 215 may transmit an electrical pulse (also referred to as a "signal") to the actuator mechanism 220, and the actuator mechanism 220 may cause the gun 200 to propel a projectile through the barrel 235. For example, the actuator mechanism 220 may receive the signal and displace a sear in response to receiving the signal, causing a striker or hammer to be released, a firing pin to collide with a cartridge primer, propellant to be ignited, and a projectile to be propelled through the barrel 235. In another example, the actuator mechanism 220 may direct current through a conductive material, and the current in conductive material may ignite the propellent of an electronically activated cartridge, causing a projectile to be propelled through the barrel 235.

The fire control manager 215 may identify a trigger break based on the trigger sensing mechanism 210, and the fire control manager 215 may transmit the signal to the actuator mechanism 220 based on the trigger break. In some examples, the trigger sensing mechanism 210 may include a trigger sensor, such as the Hall effect sensor 225, and an activation component, such as the magnet 230. The Hall effect sensor 225 may generate a voltage based on the trigger 205 moving the magnet 230 within a threshold distance of the Hall effect sensor 225, the fire control manager 215 may identify the voltage generated by the Hall effect sensor 225, and the fire control manager 215 may transmit the signal to the actuator mechanism 220 based on the Hall effect sensor 225 generating the voltage. In some cases, the fire control manager 215 may transmit the signal to the actuator mechanism 220 based on multiple factors, such as the voltage and an armed state of the gun 200, the voltage and a successful user authentication procedure, or the voltage, a successful user authentication procedure, and a successful user presence procedure.

The Hall effect sensor 225 may generate a voltage based on the trigger 205 moving the magnet 230 within a threshold distance of the Hall effect sensor 225, and the magnet 230 may be located within the threshold distance of the Hall effect sensor 225 based on the trigger 205 dislocating a detent mechanism. Dislocating the detent mechanism may include displacing a mechanical detent such as a spring-loaded ball detent or a leaf spring, and the threshold distance of the Hall effect sensor 225 may correspond to a distance between the magnet 230 and the Hall effect sensor 225 that results in Hall effect sensor 225 generating a voltage that indicates activation of the Hall effect sensor 225. The Hall effect sensor 225 may generate an output voltage (e.g., a high voltage) based on the density of magnetic flux, and the magnet 230 may produce a magnetic field. The distance from the Hall effect sensor 225 at which the magnet 230 produces a magnetic field with a flux density that triggers the Hall effect sensor 225 to generate the output voltage may correspond to the threshold distance of the Hall effect sensor 225. As such, the threshold distance of the Hall effect sensor 225 may be based on the sensitivity of the Hall effect sensor 225 and the strength of the magnet 230.

Figure 3:
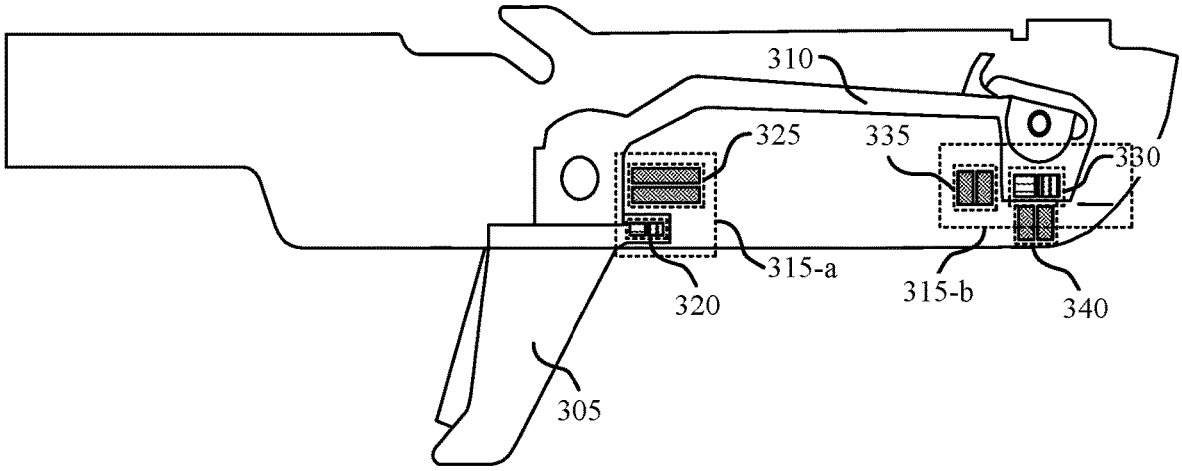
FIG. 3 illustrates an example of trigger sensing system that supports an electromechanical trigger in accordance with aspects of the present disclosure.

FIG. 3 illustrates an example of a trigger sensing system 300 that supports an electromechanical trigger in accordance with aspects of the present disclosure. The trigger sensing system 300 may be an aspect of a gun, such as the gun 100 as described with reference to FIG. 1 or the gun 200 as described with reference to FIG. 2.

The trigger sensing system 300 illustrates an example trigger sensing mechanism 315-*a* and an example trigger sensing mechanism 315-*b*. The trigger sensing system 300 includes a trigger body 305 and a trigger bar 310, which may both be aspects of a trigger mechanism that allows a user to fire the gun. The trigger sensing mechanism 315-*a* supports detecting movement of the trigger body 305, and the trigger sensing mechanism 315-*b* supports detecting movement of the trigger bar 310. The gun may include a fire control manager that supports identifying a trigger beak based on the trigger sensing mechanism 315-*a* or the trigger sensing mechanism 315-*b*.

The trigger sensing mechanism 315-*a* includes a trigger sensor 325 and an activation component 320. The trigger sensing mechanism 315-*a* supports identifying a trigger break based on movement of the trigger body 305. For example, the trigger sensor 325 may be located on an interior surface of the frame of the gun, and the trigger sensor 325 may generate an output indicating a trigger break based on movement of the activation component 320.

The trigger sensor 325 may include Hall effect sensor, a pressure sensor, a photosensor, an optical switch, a Reed switch, a physical switch, or the like, and the activation component 320 may include a magnet, a protrusion, a light-blocking material, or the like. As an illustrative example, the trigger sensor 325 may be a Hall effect sensor and the activation component 320 may be a magnet. As the magnet passes the Hall effect sensor, or comes within a threshold distance of the Hall effect sensor, the fire control manager may identify a trigger break based on an output voltage generated by the Hall effect sensor, and the fire control manager may transmit a signal to an actuator mechanism to fire the gun. As another example, the trigger sensor 325 may include a photosensor and the activation component 320 may include a dense material, such as an alloy or polymer that activates photosensor when the trigger is moved, and the fire control manager may transmit a signal to an actuator mechanism based on the activation of the photosensor, where transmitting the signal to the actuator mechanism resulting in the gun firing a projectile. In yet another example, the trigger sensor 325 may include a physical switch, and the activation component 320 may include a protrusion that contacts the physical switch when the trigger is moved, and the fire control manager may transmit a signal to an actuator mechanism based on the protrusion contacting the physical switch, where transmitting the signal to the actuator mechanism resulting in the gun firing a projectile.

The activation component 320 may include one or multiple elements, and the trigger sensor 325 may include one or multiple elements. As an example, the activation component 320 may include one dimple and the trigger sensor 325 may include one physical switch. As another example, the activation component 320 may include two magnets and the trigger sensor 325 may include one Hall effect sensor. As yet another example, the activation component 320 may include a Hall effect sensor and a photosensor, and the trigger sensor 325 may include a magnet. In some examples, including multiple elements in the activation component 320 may improve the reliability of the trigger sensing mechanism. For example, the activation component 320 may include two magnets, and the first magnet may be located within a threshold distance of the trigger sensor 325 when the trigger body 305 is located in a default position (e.g., a position corresponding to not firing the gun), and the second magnet may be located within the threshold distance of the trigger sensor 325 when the trigger body 305 is located in an action position (e.g., a position corresponding to firing the gun, a trigger pull, a trigger break, or a dislocated detent mechanism). The trigger sensor 325 may be a unipolar Hall effect sensor that is activated based on the polarity and strength of magnetic flux. The trigger sensor 325 may be activated based on a positive magnetic flux of at least 3 millitesla (mT). The first magnet may saturate the trigger sensor 325 with a negative magnetic flux when the trigger body 305 is in the default position, and the second magnet may saturate the trigger sensor 325 with a positive magnetic flux of at least 3 mT when the trigger body 305 is in the action position. The trigger sensor 325 may activate (e.g., generate an output voltage indicating a trigger break) based on the polarity (e.g., positive) and strength (e.g., 1 mT, 3 mT, 5 mT, 8 mT, etc.) of the magnetic flux. As another example, the trigger mechanism may include one magnet with a first polarity (e.g., negative) located with a threshold distance of the trigger sensor 325 while in the default position and a second polarity (e.g., positive) located within the threshold distance of the trigger sensor 325 while in the action position.

The trigger sensing mechanism 315-*b* includes an activation component 330, a trigger sensor 335, and a trigger sensor 340. The trigger sensing mechanism 315-*b* supports identifying a trigger break based on movement of the trigger bar 310. The trigger sensor 335 illustrates a location of the trigger sensor in front of the activation component 330, and the trigger sensor 340 illustrates a location of the trigger sensor beneath the activation component 330. The trigger sensor may include Hall effect sensor, a pressure sensor, a photosensor, an optical switch, a Reed switch, a physical switch, or the like, and the activation component 330 may include a magnet, a protrusion, a light-blocking material, or the like. In some examples, the gun may include the trigger sensing mechanism 315-*b*, and the trigger sensing mechanism 315-*b* may include a photosensor located in front of the trigger bar 310 (as shown by the location of the trigger sensor 335) and a Hall effect sensor located beneath the trigger bar 310 (as shown by the location of the trigger sensor 340). In such examples, the fire control manager may transmit a signal to activate the actuator mechanism based on activation of both the photosensor (which may, for example, be activated in response to the trigger bar 310 interrupting or obstructing a beam of light) and the Hall effect sensor (which may, for example, be activated in response to the polarity and strength of magnetic flux).

The trigger sensing system 300 may include a Hall effect sensor, such as a linear Hall sensor, a Digital Hall sensor, an omnipolar Hall sensor, or a unipolar Hall sensor, a photosensor, such as a through-beam sensor, a retro-reflective sensor, or a diffuse-reflective sensor. The trigger sensing system 300 may additionally or alternatively include a magnetic proximity sensor, an optical proximity sensor, a capacitive proximity sensor, an inductive proximity sensor, an ultrasonic proximity sensor, or the like.

Figure 4:
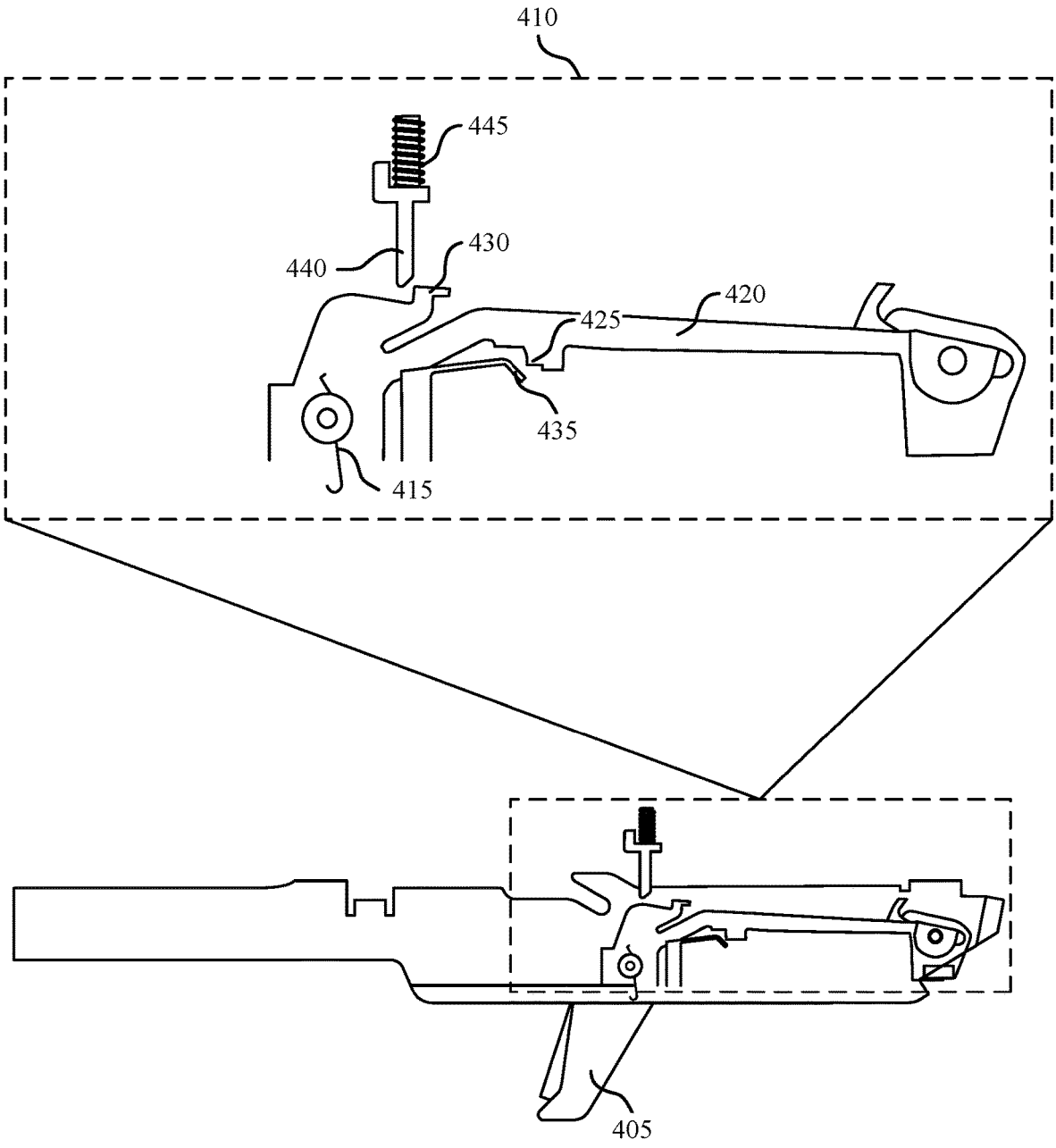
FIG. 4 illustrates an example of detent system that supports an electromechanical trigger in accordance with aspects of the present disclosure.

FIG. 4 illustrates an example of a detent system 400 that supports an electromechanical trigger in accordance with aspects of the present disclosure. The detent system 400 may be an aspect of a gun, such as the gun 100 as described with reference to FIG. 1 or the gun 200 as described with reference to FIG. 2.

The detent system 400 includes a trigger body 405 and a view 410 illustrating a trigger spring 415, a firing pin safety 440, and a trigger bar detent 435. As a user (e.g., a shooter, an operator of the gun, etc.) pulls the trigger body 405, force is exerted onto the trigger spring 415. As the trigger is pulled, the protrusion 430 on the trigger bar 420 displaces the firing pin safety 440. The firing pin safety includes a spring 445, which applies force to the firing pin safety 440 such that the firing pin safety 440 blocks the path of the firing pin by default, inhibiting the gun from being fired until the protrusion 430 applies force to the firing pin safety 440 and overcomes the force applied by the spring 445 such that the firing pin safety 440 is displaced out of the path of the firing pin.

As the trigger body 405 is pulled, the trigger bar 420 is also pulled such that the protrusion 425 contacts the trigger bar detent 435. The trigger bar 420 may moving past the trigger bar detent 435, and the gun may include a trigger sensing mechanism configured to identify a trigger break based on the trigger bar 420 displacing the trigger bar detent 435. For example, the trigger sensing mechanism may generate a voltage based on the trigger bar 420 passing the trigger bar detent 435, a fire control manager may identify the trigger break based on the voltage, and the fire control manager may transmit a signal to an actuator mechanism to fire the gun in response to identifying the trigger beak.

The detent system 400 may be adjustable to modify a trigger weight or feel. In some examples, the trigger bar detent 435 may be adjusted to alter the force profile of the trigger. For example, the trigger weight may be adjusted by altering the angle at which the protrusion 425 contacts the trigger bar detent 435. An adjuster component (e.g., a screw or fastener) may be turned to change the angle of the trigger bar detent 435. The angle of the trigger bar detent 435 with respect to the protrusion 425 may be reduced to decrease the trigger weight, and the angle of the trigger bar detent 435 with respect to the protrusion 425 may be enlarged to increase the trigger weight. In some examples, the detent system 400 may be adjusted by modifying the firing pin safety 440, the trigger bar detent 435, or the trigger spring 415, and modifying the firing pin safety 440, the trigger bar detent 435, or the trigger spring 415 may be performed by modifying an adjuster component, such as turning a screw or sliding a lever. In some examples, the gun may include additional or alternative detent mechanisms, such as a spring-loaded ball detent, a magnetic detent, a pneumatic detent, or the like.

Figure 5:
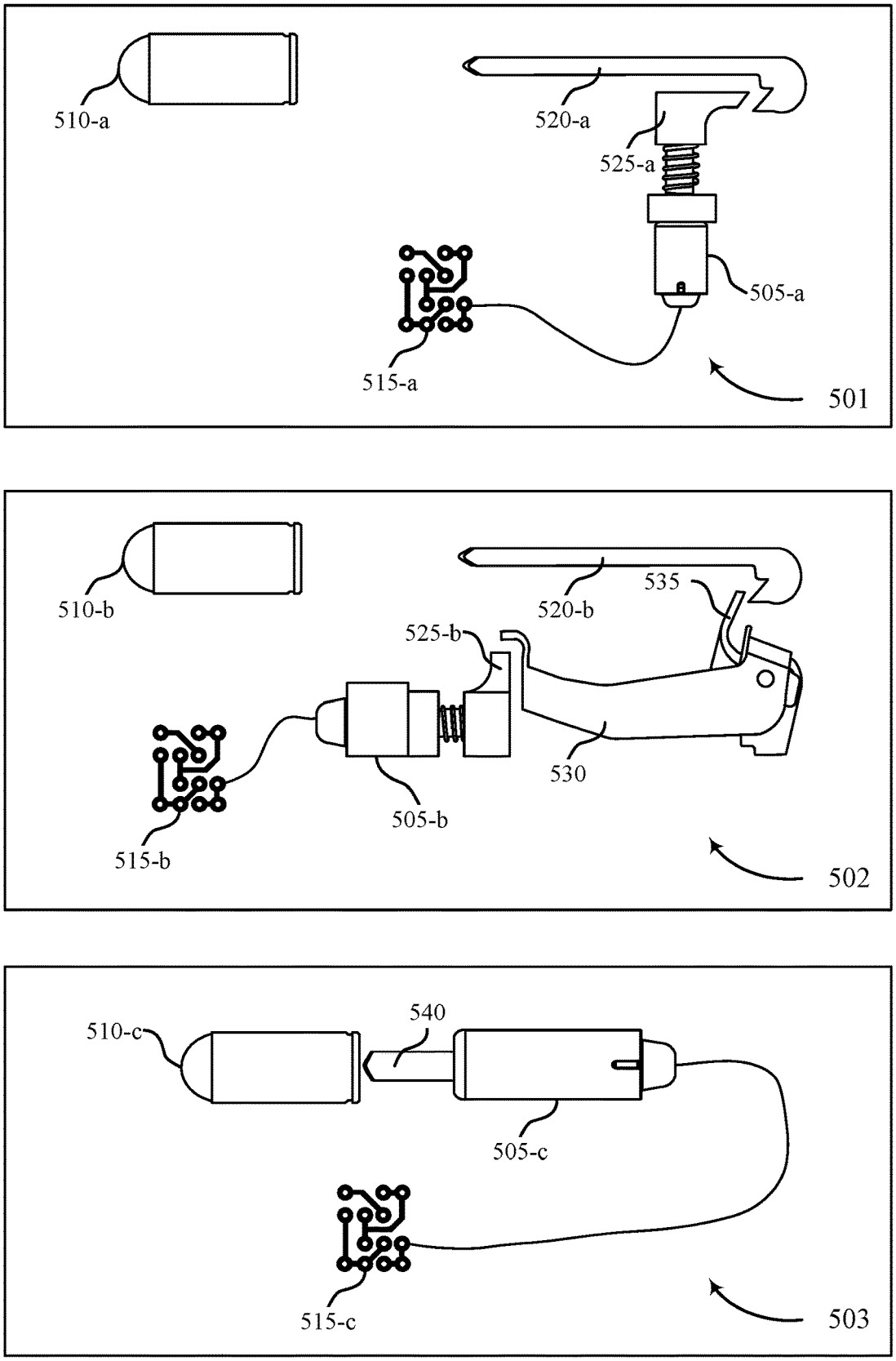
FIG. 5 illustrates examples of actuator mechanisms that support an electromechanical trigger in accordance with aspects of the present disclosure.

FIG. 5 illustrates an example of an actuator mechanism 501, an actuator mechanism 502, and an actuator mechanism 503 that support an electromechanical trigger in accordance with aspects of the present disclosure. The actuator mechanism 501, the actuator mechanism 502, or actuator mechanism 503 may be an aspect of a gun, such as the gun 100 as described with reference to FIG. 1 or the gun 200 as described with reference to FIG. 2.

The actuator mechanism 501 illustrates an example of an actuator 505-*a* that may be used in a gun to propel the projectile 510-*a* from a gun. The fire control manager 515-*a* may identify a trigger break and transmit a signal to the actuator 505-*a*. In response to receiving the signal from the fire control manager 515-*a*, the actuator 505-*a* may move the actuator block 525-*a* out of the way of the striker 520-*a*, allowing the striker 520-*a* to strike the cartridge primer for the projectile 510-*a*, ignite the propellent, and propel the projectile 510-*a* from the gun.

The actuator mechanism 502 illustrates an example of an actuator 505-*b* that may be used in a gun to propel the projectile 510-*b* from the gun. The fire control manager 515-*b* may identify a trigger break and transmit a signal to the actuator 505-*b*. In response to receiving the signal from the fire control manager 515-*b*, the actuator 505-*b* may move the actuator block 525-*b* out of the way of the sear linkage 530, resulting in the sear linkage 530 dropping and the sear 535 releasing the striker 520-*b*, allowing the striker 520-*b* to strike the cartridge primer for the projectile 510-*b*, ignite the propellent, and propel the projectile 510-*b* from the gun.

The actuator mechanism 503 illustrates an example of an actuator 505-*c* that may be used in a gun to propel a projectile 510-*c* from the gun. The fire control manager 515-*c* may identify a trigger break and transmit a signal to the actuator 505-*c*. In response to receiving the signal from the fire control manager 515-*c*, the actuator 505-*c* may direct electric current to the conductive firing pin 540, resulting in ignition of the propellent for the projectile 510-*b* and propulsion of the projectile 510-*b* from the gun. For example, the cartridge for the projectile 510-*c* may include an electrically activated primer that is ignited in response to the conductive firing pin 540 carrying the electric current directed from the actuator 505-*c*.

Figure 6:
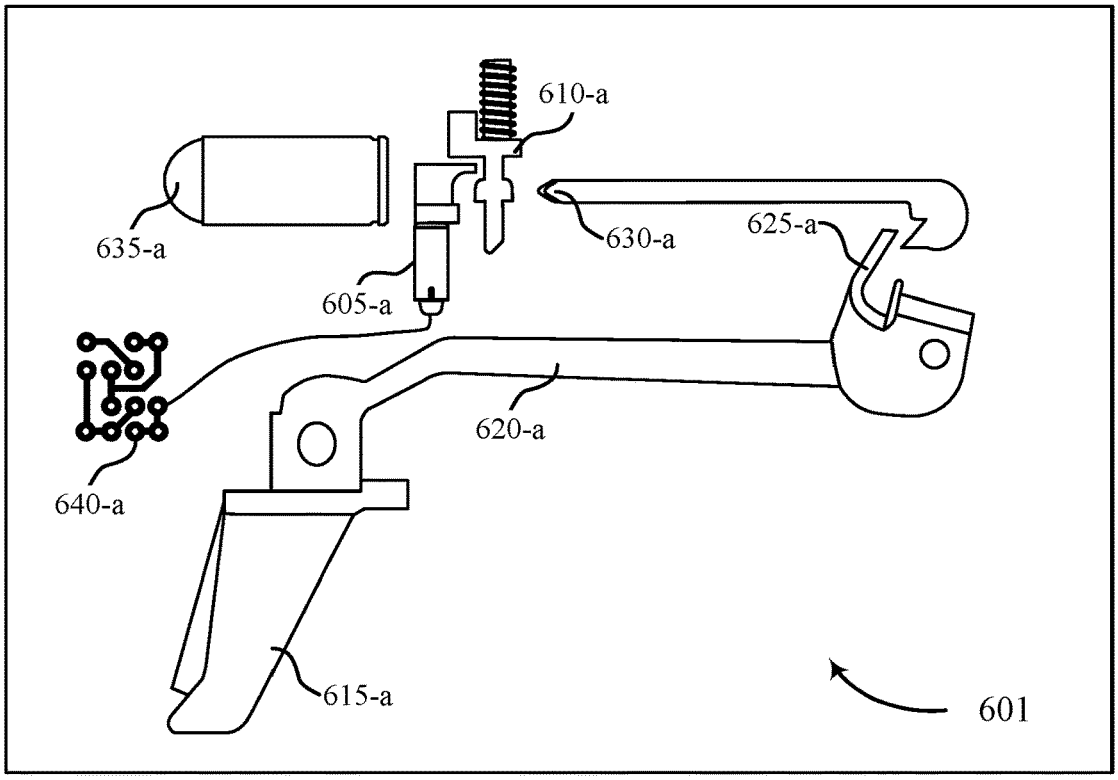
FIG. 6 illustrates examples of inhibitor mechanisms that support an electromechanical trigger in accordance with aspects of the present disclosure.
Figure 6:
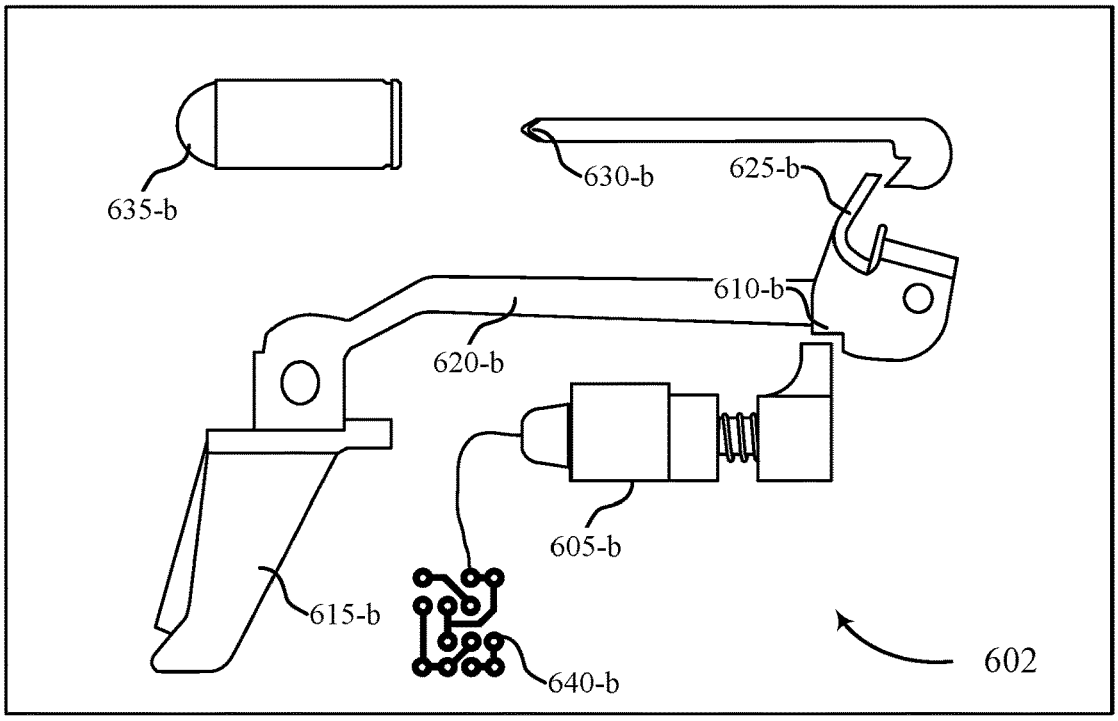

FIG. 6 illustrates an example of an inhibitor mechanism 601 and an inhibitor mechanism 602 that support an electromechanical trigger in accordance with aspects of the present disclosure. The inhibitor mechanism 601 or the inhibitor mechanism 602 may be an aspect of a gun, such as the gun 100 as described with reference to FIG. 1 or the gun 200 as described with reference to FIG. 2.

The inhibitor mechanism 601 illustrates an example of a firing pin safety 610-*a* which obstructs the firing pin 630-*a* while engaged. The actuator 605-*a* may be activated to disengage the firing pin safety 610-*a* such that the firing pin 630-*a* is able to strike the cartridge primer for the projectile 635-*a*, ignite the propellent, and propel the projectile 635-*a* from the gun.

The trigger body 615-*a* may be coupled with the trigger bar 620-*a*, and a user (e.g., a shooter) may pull the trigger body 615-*a*, causing the trigger bar 620-*a* to also move. Pulling the trigger body 615-*a* results in movement of the sear 625-*a* and release of the striker, causing the firing pin 630-*a* to strike the cartridge primer. The fire control manager 640-*a* may identify the trigger movement based on a trigger sensing mechanism, and the fire control manager may transmit a signal to the actuator 605-*a* in response to the trigger movement. In response to receiving the signal, the actuator 605-*a* may displace the firing pin safety 610-*a* such that the firing pin safety 610-*a* allows the firing pin 630-*a* to striker the cartridge primer.

The inhibitor mechanism 602 illustrates an example of a sear inhibitor mechanism 610-*b* which obstructs the sear 625-*b* while engaged. The actuator 605-*b* may be activated to disengage the sear inhibitor mechanism 610-*b* such that the sear 625-*b* is able to release the striker and cause the projectile 635-*b* to be fired from the gun.

The trigger body 615-*b* may be coupled with the trigger bar 620-*b*, and user may pull the trigger body 615-*b*, causing the trigger bar 620-*b* to move as well. Pulling the trigger body 615-*a* results in the release of the striker or hammer, causing the firing pin 630-*b* to strike the cartridge primer. The fire control manager 640-*b* may identify the trigger movement based on a trigger sensing mechanism, and the fire control manager may transmit a signal to the actuator 605-*b*. In response to receiving the signal, the actuator 605-*b* may move from an engaged position to a disengaged position, where the engaged position inhibits the movement of the sear 625-*b* and the disengaged positions allows the sear 625-*b* to move such that the striker or hammer is released. FIG. 6 illustrates firing pins coupled with strikers, but it should be understood that a hammer may be used instead of a striker to facilitate the collision between the firing pin and the cartridge primer.

Figure 7:
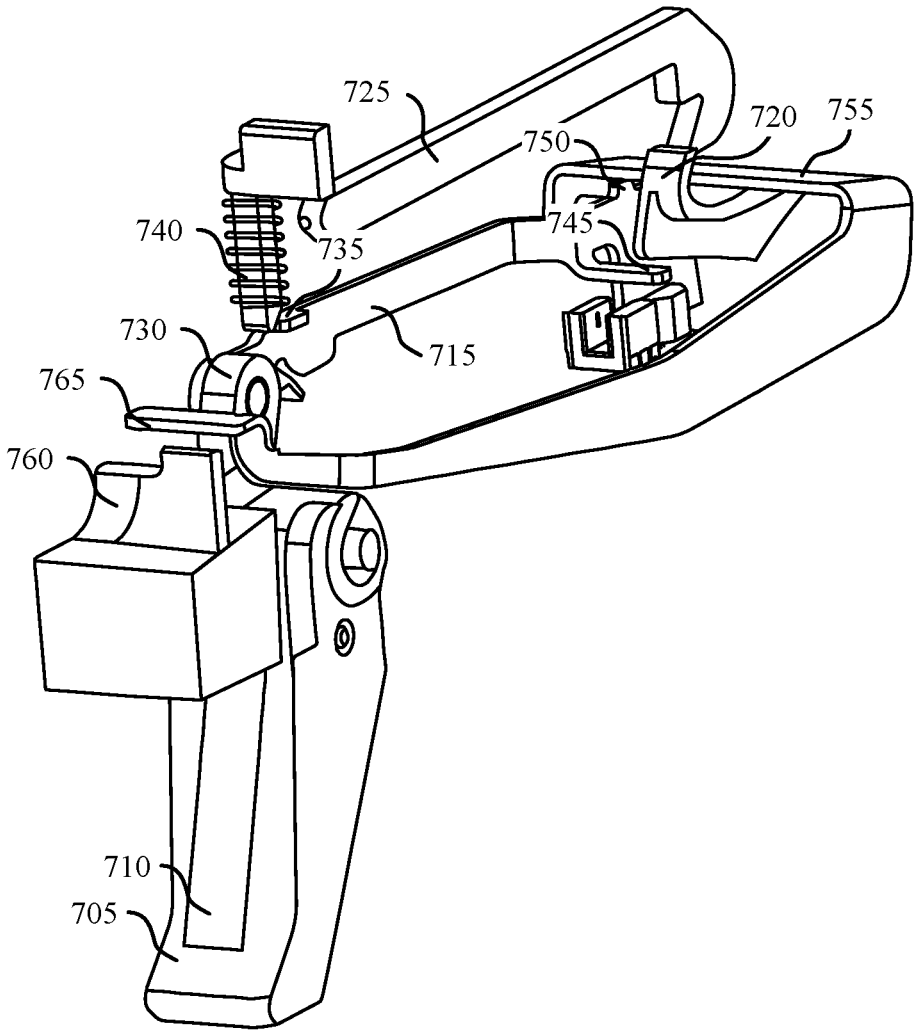
FIG. 7 illustrates an example of a trigger system that supports an electromechanical trigger in accordance with aspects of the present disclosure.

FIG. 7 illustrates an example of a trigger system 700 that supports an electromechanical trigger in accordance with aspects of the present disclosure. The trigger system 700 may be an aspect of a gun, such as the gun 100 as described with reference to FIG. 1 or the gun 200 as described with reference to FIG. 2.

The trigger system 700 includes examples of mechanical safety features which may be included in a gun described herein. A gun may include one or more mechanical safety features, an actuator mechanism, and/or an inhibitor mechanism. Including mechanical safety features, as illustrated in the trigger system 700, improves gun safety by increasing the number of safeties and types of safeties in the gun.

The trigger system 700 includes a trigger body 705, a trigger safety 710, a trigger bar 715, and a sear 720 which is configured to retain the striker 725 and release the striker 725 based on a user pulling the trigger body 705. The trigger body 705 is coupled with the trigger bar 715 at the trigger fulcrum 730. The protrusion 735 on the trigger bar 715 is positioned to displace the firing pin safety 740 based on movement of the trigger bar 715. The drop safety 745 is positioned to inhibit movement of the sear 720 while in a default position and allow movement of the sear 720 while in an action position. Additionally, the linkage safety 750 is positioned to inhibit movement of the linkage 755 while in a default position and allow movement of the linkage 755 while in an action position. A default position can be considered a safe, disarmed, or locked position that inhibits the gun from firing. An action position can be considered a fire, armed, or unlocked position that allows and/or causes the gun to fire. For example, the action position of the firing pin safety 740 may allow the striker 725 to strike a cartridge primer, while the actuator 760 assuming the action position causes movement of the linkage bar 765, resulting in the sear 720 releasing the striker 725, causing the striker 725 to collide with the cartridge primer, ignite the propellent, and propel the projectile from the gun.

Figure 8:
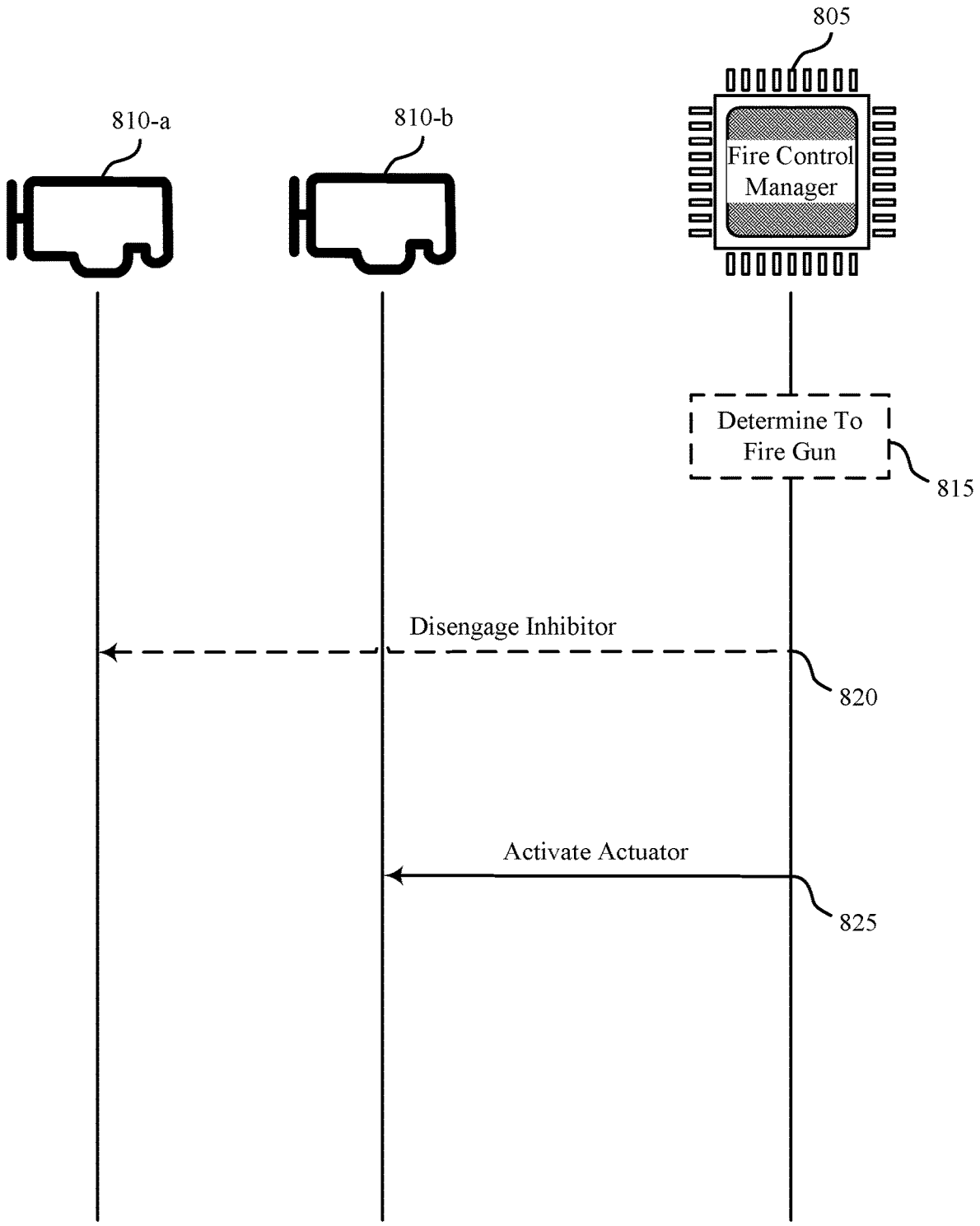
FIG. 8 illustrates an example of a process flow that supports an electromechanical trigger in accordance with aspects of the present disclosure.

FIG. 8 illustrates an example of a process flow 800 that supports an electromechanical trigger in accordance with aspects of the present disclosure. The process flow 800 includes a fire control manager 805, an inhibitor mechanism 810-*a*, and an actuator mechanism 810-*b*, which may be examples of the corresponding components described with reference to FIGS. 1 through 7. The fire control manager 805, the inhibitor mechanism 810-*a*, and/or the actuator mechanism 810-*b* may be components of a gun described herein. Alternative examples of the following may be implemented, where some steps are performed in a different order than described or are not performed at all. In some cases, steps may include additional features not mentioned below, or further steps may be added.

The fire control manager 805 may manage a firing system, which may include an electromechanical trigger. The fire control manager 805 may implement logic to control the firing of the gun, and the fire control manager 805 may include analog circuits, digital circuits, a processor, or other components that support performing logical functions. In some examples, the fire control manager 805 may include analog and/or digital circuits that monitor a trigger mechanism for a trigger break and transmit a signal to an inhibitor mechanism (e.g., an electromechanical safety) and/or and actuator mechanism (e.g., an electromechanical fire control actuator) in response to identifying a trigger break. For example, the fire control manager 805 may identify a trigger break based on a trigger sensor generating a voltage, and the fire control manager 805 may transmit a signal to an actuator to activate the actuator mechanism and cause the gun to fire a projectile. Implementing the fire control manger 805, or aspects thereof, in circuits may improve system reliability and reduce latency.

At step 815, the fire control manager 805 may determine that the gun is to be fired. The fire control manager 805 may determine that the gun is to be fired based on identifying a trigger break. For example, a trigger component (e.g., a trigger bar, a trigger body, etc.) may be displaced a distance threshold and/or a force threshold in response to a user pulling the trigger, a trigger sensing component may generate an output based on the trigger component being displaced the threshold distance, and the fire control manager 805 may determine that the gun is to be fired in response to the output generated by the trigger sensing mechanism. In some examples, the displacement threshold and/or the force threshold may be configured by an operator of the gun. For example, the operator may adjust a detent mechanism to configure the force threshold, and the trigger break may be identified based on the trigger movement satisfying the force threshold. Regardless of whether movement is compared against a threshold value or pattern, the fire control manager 805 may be said to be monitoring for, and then identifying, "trigger breaks." Accordingly, the term "trigger break" may refer to a situation where the trigger moves from its default position in such a manner so as to indicate that the gun is to be fired.

At step 820, the fire control manager 805 may transmit a signal to the inhibitor mechanism 810-*a*. The fire control manager 805 may transmit the signal to the inhibitor mechanism 810-*a* based on determining that the gun is to be fired at step 815. In some examples, the fire control manager 805 may refrain from transmitting the signal to the inhibitor mechanism 810-*a*, or the gun may not include the inhibitor mechanism 810-*a*. The inhibitor mechanism may be an example of an electromechanical firing pin safety, an electromechanical drop safety, an electromechanical trigger safety, or the like At step 825, the fire control manager 805 may transmit a signal to the actuator mechanism 810-*b*. The fire control manager 805 may transmit the signal to the actuator mechanism 810-*b* based on determining that the gun is to be fired at step 815. Transmitting the signal to the actuator mechanism 810-*b* may activate the actuator mechanism 810-*b*, resulting in the gun firing a projectile. For example, in response to receiving the signal, the actuator mechanism 810-*b* may displace an actuator block, causing the release of a sear, the release of a striker, or the release of a hammer. Releasing the sear, striker, or hammer may cause a firing pin to striker a cartridge primer, ignite the propellant, and propel the projectile form the gun. As another example, in response to receiving the signal, the actuator mechanism 810-*b* may direct current to a conductive material configured to ignite an electrically activated cartridge primer, causing the propellant to ignite and the projectile to be propelled from the gun. In yet another example, in response to receiving the signal, the actuator mechanism 810-*b* may direct electric current to create a magnetic field that interacts with another electric current to create an electromagnetic force that propels the projectile from the gun (e.g., as in the case of a railgun).

Figure 9:
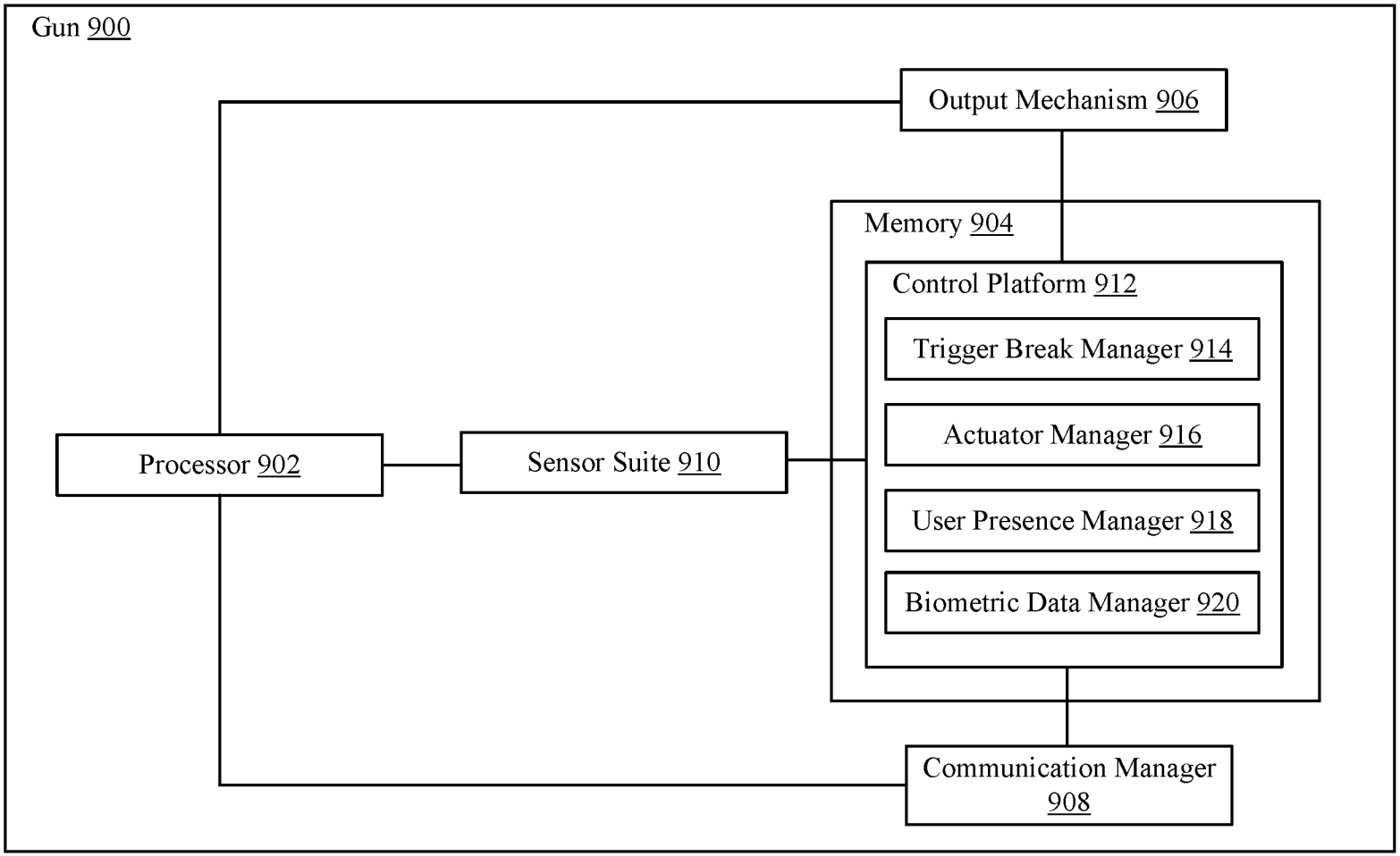
FIG. 9 illustrates an example of a gun that supports an electromechanical trigger in accordance with aspects of the present disclosure.

FIG. 9 illustrates an example of a gun 900 able to implement a control platform 912 designed to produce outputs that are helpful in ensuring the gun 900 is used in an appropriate manner. As further discussed below, the control platform 912 (also referred to as a "management platform" or a "fire control manager") may be designed to may be designed to identify user presence at the gun 900, receive biometric data from a user, authenticate the user based on the biometric data, identify a trigger break, activate an actuator mechanism, or transition the gun 900 between states, such as an unlocked state and a locked state. Because the control platform 912 may be responsible for managing the trigger system and/or the firing of the gun 900, the control platform 912 may also be referred to as a "controller."

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an application-specific integrated circuit (ASIC) that provides control functions to the gun 900. As illustrated in FIG. 9, the processor 902 can be coupled, directly or indirectly, with components of the gun for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips or managers.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth®, Wi-Fi®, Near Field Communication (NFC), and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor (e.g., a photoelectric sensor, a capacitive sensor, an inductive sensor, etc.) whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint sensor or camera that generates images which can be used for, for example, biometric authentication. As yet another example, the gun 900 may include a trigger sensor, such as a Hall effect sensor, a photoelectric sensor, a mechanical switch, or the like. As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may include a trigger break manager 914, an actuator manager 916, a user presence manager, 918, and a biometric data manager 920. As an illustrative example, the trigger break manager 914 may process data generated by, and obtained from, a trigger sensor (e.g., a Hall effect sensor), the actuator manager 916 may control the movement of an actuator mechanism, the user presence manager 918 may process data generated by, and obtained from, a photoelectric proximity sensor, and the biometric data manager 920 may process data generated by, and obtained from, a biometric sensor (e.g., a fingerprint scanner, a camera, etc.). The trigger sensor may be an aspect of a trigger sensing mechanism, and the control platform 912 may identify a trigger break based on the trigger sensing mechanism and activate an actuator mechanism (e.g., by transmitting a signal to the actuator mechanism) in response to identifying the trigger break. The gun 900 may fire a projectile in response to activating the actuator mechanism. Because the data obtained by these managers may have different formats, structures, and content, the instructions executed by these managers can (and often will) be different. For example, the instructions executed by the biometric data manager 920 to process data generated by a biometric sensor may be different than the instructions generated by the user presence manager 918 to process data generated by a user presence sensor, such as a photoelectric sensor, a capacitive sensor, or an inductive sensor. Also, different managers may use different hardware to implement logic or execute instructions. For example, the biometric data manager 920 may use a processor to process the data generated by the biometric sensor, and the trigger break manager 914 may use an analog circuit to process the data generated by the trigger sensor.

Figure 10:
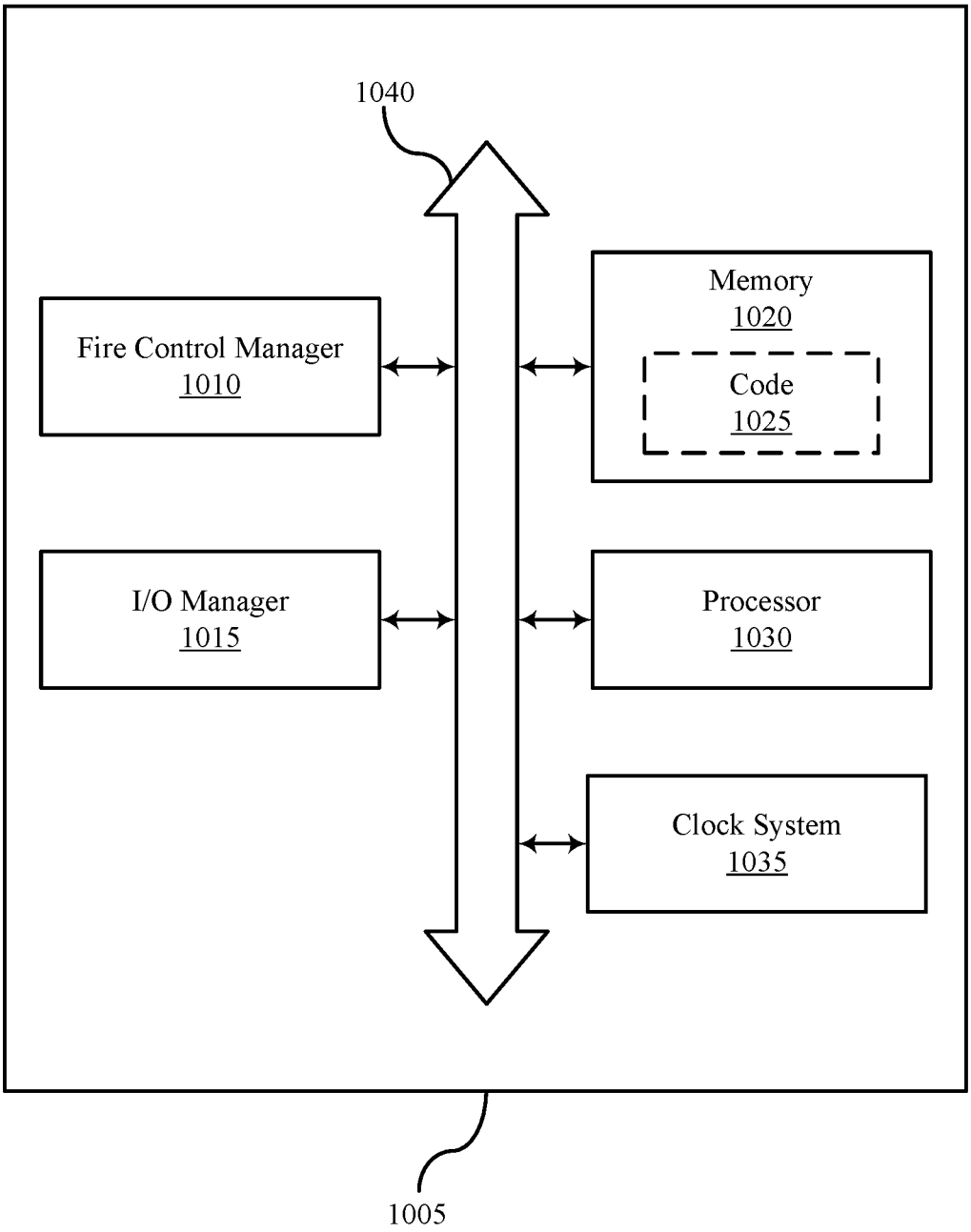
FIG. 10 illustrates an example of a system that supports an electromechanical trigger in accordance with aspects of the present disclosure.

FIG. 10 illustrates an example of a system 1000 that supports an electromechanical trigger in accordance with aspects of the present disclosure. The device 1005 may be operable to implement the techniques, technology, or systems disclosed herein. The device 1005 may include components such as a fire control manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, an electromechanical trigger, a fire control system, a trigger system, or a gun.

The device 1005 may include a detent mechanism, and the detent mechanism may be dislocated in response to a force being applied to a trigger mechanism of the device 1005 that is sufficient to cause the trigger mechanism to be displaced past the detent mechanism. The fire control manager 1010 may identify, based on an output produced by a trigger sensing mechanism located proximate to the trigger mechanism, trigger movement satisfying a trigger break threshold, and transmit, based on the identifying the trigger movement, a signal to an actuator mechanism that facilitates the firing of the gun. Transmitting the signal to the actuator mechanism may cause displacement of the actuator mechanism, wherein the displacement of the actuator mechanism results in the gun firing the projectile through a barrel.

The fire control manager 1010 may identify, based on an output produced by a trigger sensing mechanism located proximate to the trigger mechanism, trigger movement, and transmit, based on the identifying the trigger movement, a signal to an actuator mechanism that facilitates the firing of the gun. Transmitting the signal to the actuator mechanism may cause displacement of the actuator mechanism, wherein the displacement of the actuator mechanism results in the gun firing the projectile through a barrel.

The device 1005 may include a rifled barrel, a trigger mechanism comprising a magnet, a trigger sensing mechanism configured to generate a voltage in response to the trigger mechanism displacing a detent mechanism and the magnet being within a threshold distance of the trigger sensing mechanism, and the fire control manager 1010. The fire control manager 1010 may be configured to: identify a trigger break based on the trigger sensing mechanism generating the voltage, and transmit a signal to an actuator mechanism, wherein the actuator mechanism is displaced in response to the transmitting the signal, and the displacing the actuator mechanism results in a projectile being propelled through the rifled barrel.

The device 1005 may include a detent mechanism located in a displacement path of a trigger bar, a trigger body coupled with the trigger bar, the trigger body configured to undergo three stages of travel, the three stages of travel comprising: a take up stage of travel, the take up stage of travel corresponding to trigger movement that displaces a spring associated with a rate of deflection, a wall stage of travel, the wall stage of travel corresponding to trigger movement that displaces a second spring associated with a second rate of deflection that is higher than the rate of deflection, and an overtravel stage of travel that occurs based on the trigger mechanism being displaced through the take up stage of travel and the wall stage of travel. The trigger body may undergo the three stages of travel based on the trigger bar displacing the detent mechanism while traveling along the displacement path. The device 1005 may include a trigger reset spring positioned such that the trigger reset spring is in contact with the trigger body, the trigger body configured to undergo a fourth stage of travel based on the trigger reset spring, wherein the fourth stage of travel corresponds to a reset stage. The trigger body may travel in a first direction during the three stages of travel, and the trigger body may travel in a second direction that is substantially opposite the first direction during the fourth stage of travel.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, a radio frequency identification (RFID) sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed, the code 1025 may cause the processor 1030 to perform various operations or functions described here.

The processor 1030 may be an example or component of a central processing unit (CPU), an application specific integrated circuit (ASIC), or a field programmable gate array (FPGA). In some embodiments, the processor 1030 may utilize an operating system or software such as Microsoft Windows®, iOS®, Android®, Linux, Unix®, or the like. The clock system 1035 control a timer for use by the disclosed embodiments.

The fire control manager 1010, or its sub-components, may be implemented in hardware, software (e.g., software or firmware) executed by a processor, or a combination thereof. The fire control manager 1010, or its sub-components, may be physically located in various positions. For example, in some cases, the fire control manager 1010, or its sub-components may be distributed such that portions of functions are implemented at different physical locations by one or more physical components.

FIG. 11 illustrates an example of a flowchart 1100 that shows a process by which a gun that includes an electromechanical trigger is manufactured. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1105). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. For example, the manufacturer may order a batch of trigger components (e.g., a trigger body, a trigger bar, a spring, etc.) from a vendor, and the manufacturer may verify the quality of the trigger components as part of step 1110, such as the dimension tolerances of the trigger components. Often, the manufacturer will obtain some parts and make other parts that are assembled together to form the gun (or a component of the gun).

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1110). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, such as the sear and the trigger, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

Thereafter, the manufacturer may ship the gun to a dealer (step 1115). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1105 and 1110 either sequentially or simultaneously (e.g., one component may be tested while another component is added to the gun). Thus, the descriptions of these processes are intended to be open ended.

Figure 12:
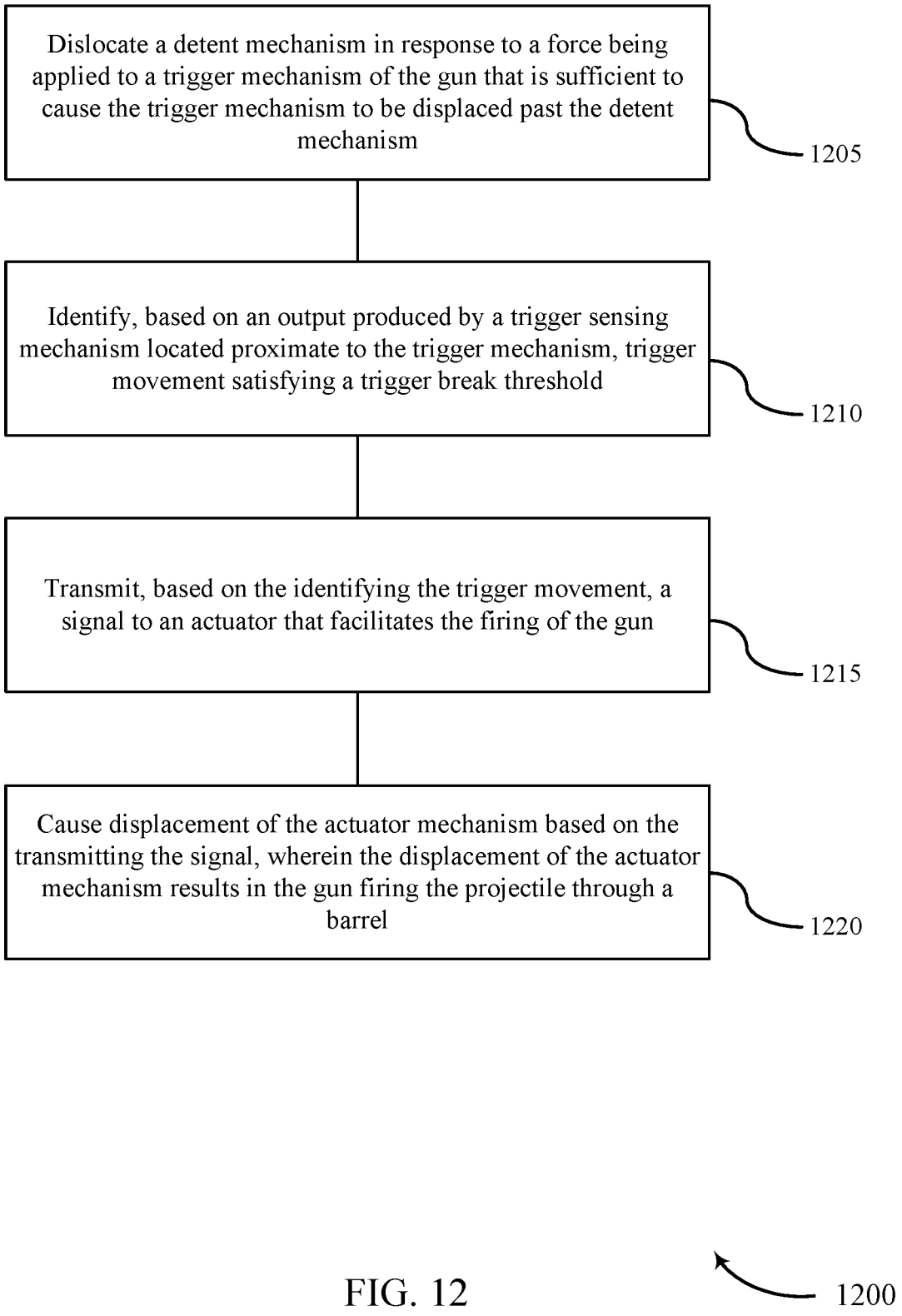
FIG. 12 illustrates an example of a flowchart that supports an electromechanical trigger in accordance with aspects of the present disclosure.

FIG. 12 shows a flowchart illustrating a method 1200 of operating a gun that includes an electromechanical trigger. The operations of the method 1200 may be implemented by a fire control manager, a gun or its components as described herein. For example, the operations of the method 1200 may be performed by a fire control manager 1010 as described with as described with reference to FIG. 10, a control platform 912 as described with reference to FIG. 9, a fire control manager 805 as described with reference to FIG. 8, a fire control manager 640-*a* as described with reference to FIG. 6, a fire control manager 640-*b* as described with reference to FIG. 6, a fire control manager 515-*a* as described with reference to FIG. 5, a fire control manager 515-*b* as described with reference to FIG. 5, a fire control manager 515-*c* as described with reference to FIG. 5, or a fire control manager 215 as described with reference to FIG. 2. In some examples, a gun may execute a set of instructions to control the functional elements of the to perform the described functions. Additionally or alternatively, the gun may perform aspects of the described functions using special-purpose hardware.

At step 1205, the gun may dislocate a detent mechanism in response to a force being applied to a trigger mechanism of the gun that is sufficient to cause the trigger mechanism to be displaced past the detent mechanism.

At step 1210, the gun may identify, based on an output produced by a trigger sensing mechanism located proximate to the trigger mechanism, trigger movement satisfying a trigger break threshold.

At step 1215, the gun may transmit, based on the identifying the trigger movement, a signal to an actuator mechanism that facilitates the firing of the gun.

At step 1220, the actuator mechanism may be displaced in response to transmitting the signal to the actuator mechanism. For example, the actuator mechanism may include a solenoid-based actuator or a piezoelectric-based actuator that is activated in response to the signal. In other words, the signal may cause activation of the actuator such that the actuator, or a component thereof, is displaced. The displacement of the actuator mechanism results in the gun firing the projectile through a barrel.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 13:
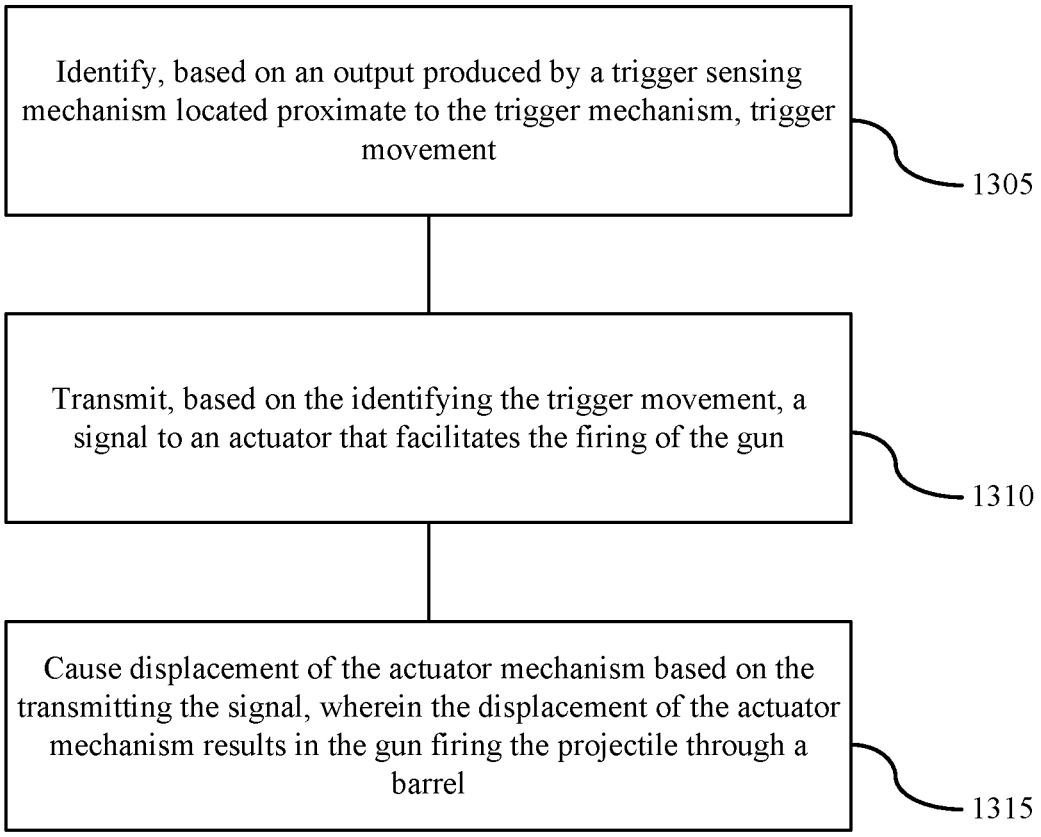
FIG. 13 illustrates an example of a flowchart that supports an electromechanical trigger in accordance with aspects of the present disclosure.

FIG. 13 shows a flowchart illustrating a method 1300 of operating a gun that includes an electromechanical trigger. The operations of the method 1300 may be implemented by a gun or its components as described herein. For example, the operations of the method 1200 may be performed by a fire control manager 1010 as described with as described with reference to FIG. 10, a control platform 912 as described with reference to FIG. 9, a fire control manager 805 as described with reference to FIG. 8, a fire control manager 640-*a* as described with reference to FIG. 6, a fire control manager 640-*b* as described with reference to FIG. 6, a fire control manager 515-*a* as described with reference to FIG. 5, a fire control manager 515-*b* as described with reference to FIG. 5, a fire control manager 515-*c* as described with reference to FIG. 5, or a fire control manager 215 as described with reference to FIG. 2. In some examples, a gun may execute a set of instructions to control the functional elements of the to perform the described functions. Additionally or alternatively, the gun may perform aspects of the described functions using special-purpose hardware.

At step 1305, the gun may identify, based on an output produced by a trigger sensing mechanism located proximate to the trigger mechanism, trigger movement.

At step 1310, the gun may transmit, based on the identifying the trigger movement, a signal to an actuator mechanism that facilitates the firing of the gun.

At step 1315, the gun may cause displacement of the actuator mechanism based on the transmitting the signal, wherein the displacement of the actuator mechanism results in the gun firing the projectile through a barrel. In some examples, the transmitting the signal may cause the displacement of the actuator mechanism. For example, the actuator mechanism may be a solenoid-based actuator, a piezoelectric-based actuator, or the like, and transmitting the signal may activate the actuator such that the actuator (or component thereof) is displaced.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 14:
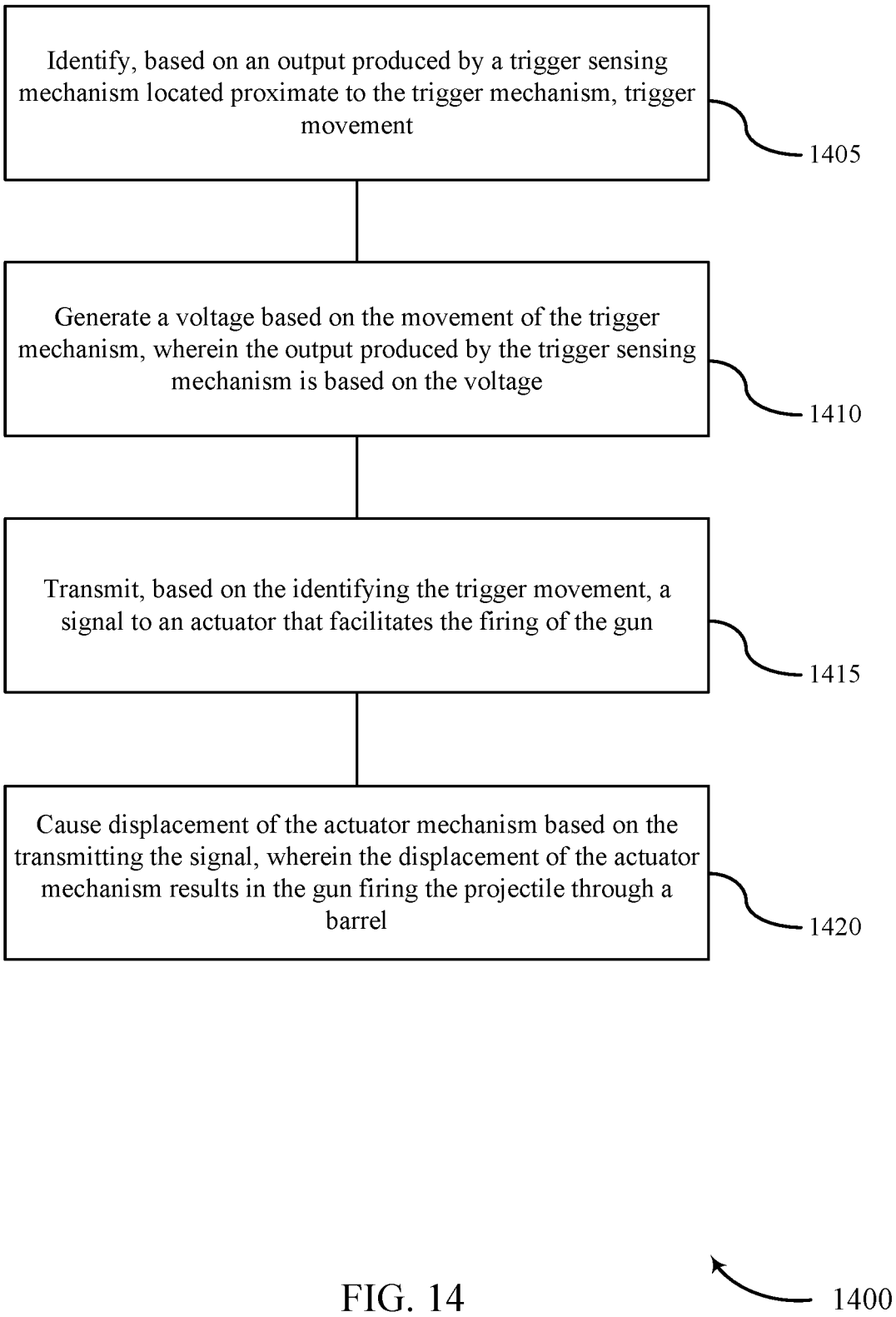
FIG. 14 illustrates an example of a flowchart that supports an electromechanical trigger in accordance with aspects of the present disclosure.

FIG. 14 shows a flowchart illustrating a method 1400 of operating a gun that includes an electromechanical trigger. The operations of the method 1400 may be implemented by a gun or its components as described herein. For example, the operations of the method 1200 may be performed by a fire control manager 1010 as described with as described with reference to FIG. 10, a control platform 912 as described with reference to FIG. 9, a fire control manager 805 as described with reference to FIG. 8, a fire control manager 640-*a* as described with reference to FIG. 6, a fire control manager 640-*b* as described with reference to FIG. 6, a fire control manager 515-*a* as described with reference to FIG. 5, a fire control manager 515-*b* as described with reference to FIG. 5, a fire control manager 515-*c* as described with reference to FIG. 5, or a fire control manager 215 as described with reference to FIG. 2. In some examples, a gun may execute a set of instructions to control the functional elements of the to perform the described functions. Additionally or alternatively, the gun may perform aspects of the described functions using special-purpose hardware.

At step 1405, the gun may identify, based on an output produced by a trigger sensing mechanism located proximate to the trigger mechanism, trigger movement.

At step 1410, the gun may generate a voltage based on the movement of the trigger mechanism, wherein the output produced by the trigger sensing mechanism is based on the voltage.

At step 1415, the gun may the gun may transmit, based on the identifying the trigger movement, a signal to an actuator mechanism that facilitates the firing of the gun.

At step 1420, the actuator mechanism may be displaced in response to transmitting the signal to the actuator mechanism. For example, the actuator mechanism may include a solenoid-based actuator or a piezoelectric-based actuator that is activated in response to the signal. In other words, the signal may cause activation of the actuator such that the actuator, or a component thereof, is displaced. The displacement of the actuator mechanism results in the gun firing the projectile through a barrel.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Examples

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the systems and techniques described herein relate to a method for firing a projectile from a gun, the method including: dislocating a detent mechanism in response to a force being applied to a trigger mechanism of the gun that is sufficient to cause the trigger mechanism to be displaced past the detent mechanism; identifying, based on an output produced by a trigger sensing mechanism located proximate to the trigger mechanism, trigger movement satisfying a trigger break threshold; transmitting, based on the identifying the trigger movement, a signal to an actuator mechanism that facilitates the firing of the gun; and causing displacement of the actuator mechanism based on the transmitting the signal, wherein the displacement of the actuator mechanism results in the gun firing the projectile through a barrel.

In some examples, the systems and techniques described herein relate to a method for firing a projectile from a gun, the method including: identifying, based on an output produced by a trigger sensing mechanism located proximate to the trigger mechanism, trigger movement; transmitting, based on the identifying the trigger movement, a signal to an actuator mechanism that facilitates the firing of the gun; and causing displacement of the actuator mechanism based on the transmitting the signal, wherein the displacement of the actuator mechanism results in the gun firing the projectile through a barrel.

In some examples, the systems and techniques described herein relate to a method, further including: determining, based on the movement of the trigger mechanism, that a trigger break threshold is satisfied, wherein the transmitting the signal is in response to the determining that the trigger break threshold is satisfied.

In some examples, the systems and techniques described herein relate to a method, wherein satisfying the trigger break threshold includes: the trigger mechanism satisfying a force threshold between 1.9 pound-force and 6.1 pound-force.

In some examples, the systems and techniques described herein relate to a method, wherein satisfying the trigger break threshold includes: the trigger mechanism satisfying a distance threshold between ⅕ inches and ⅗ inches.

In some examples, the systems and techniques described herein relate to a method, further including: generating a voltage based on the movement of the trigger mechanism, wherein the output produced by the trigger sensing mechanism is based on the voltage.

In some examples, the systems and techniques described herein relate to a method, wherein a magnet is coupled with the trigger mechanism at a location such that the trigger movement positions the magnet close enough to the trigger sensing mechanism to generate a voltage.

In some examples, the systems and techniques described herein relate to a method, wherein a second magnet is coupled with the trigger mechanism at a second location that is different from the location such that the trigger movement positions the magnet far enough from the trigger sensing mechanism to facilitate the generating of the voltage.

In some examples, the systems and techniques described herein relate to a method, further including: generating a first voltage based on a first magnet coupled with the trigger mechanism; and generating a second voltage based on a second magnet coupled with the trigger mechanism and the second magnet being positioned close enough to the trigger sensing mechanism to generate the second voltage; wherein the determining that the trigger break threshold is satisfied is in response to generating the second voltage.

In some examples, the systems and techniques described herein relate to a method, further including: displacing, in response to a shooter pulling the trigger mechanism, a detent mechanism, wherein the determining that the trigger break threshold is satisfied is based on the displacing the detent.

In some examples, the systems and techniques described herein relate to a method, wherein: the trigger mechanism includes a trigger bar; the detent mechanism includes a spring; and the spring is in a displacement path of the trigger bar.

In some examples, the systems and techniques described herein relate to a method, further including: releasing a sear based on the displacement of the actuator mechanism, wherein the projectile is fired through the barrel in response to the releasing the sear.

In some examples, the systems and techniques described herein relate to a method, wherein the trigger mechanism includes: a drop safety that is disengaged based on the movement of the trigger mechanism.

In some examples, the systems and techniques described herein relate to a method, wherein the drop safety obstructs a sear while engaged, and the drop safety does not obstruct the sear while disengaged.

In some examples, the systems and techniques described herein relate to a method, wherein the trigger mechanism includes: a firing pin safety that is disengaged based on the movement of the trigger mechanism.

In some examples, the systems and techniques described herein relate to a method, wherein the firing pin safety obstructs a firing pin while engaged, and the firing pin safety does not obstruct the firing pin while disengaged.

In some examples, the systems and techniques described herein relate to a method, wherein the identifying the movement of the trigger is further based on time-window filtering.

In some examples, the systems and techniques described herein relate to a method, wherein the identifying the movement of the trigger is further based on an edge-triggered flip-flop.

In some examples, the systems and techniques described herein relate to a method, wherein the trigger sensing mechanism includes a Hall effect sensor, an optical interrupt sensor, or a physical switch.

In some examples, the systems and techniques described herein relate to a gun, including: a rifled barrel; a sear; a trigger mechanism including: a trigger body, a trigger assembly pin, a trigger reset spring, a trigger safety, a trigger safety spring, a trigger bar, a magnet, and a detent mechanism; a trigger sensing mechanism configured to generate a voltage in response to the trigger bar displacing the detent mechanism and the magnet being within a threshold distance of the trigger sensing mechanism; and a fire control manager configured to: identify a trigger break based on the trigger sensing mechanism generating the voltage; and transmit a signal to an actuator mechanism, wherein the actuator mechanism is displaced in response to the transmitting the signal, and the displacing the actuator mechanism results in the sear being released and a projectile being propelled through the rifled barrel.

In some examples, the systems and techniques described herein relate to a gun, including: a rifled barrel; a trigger mechanism including a magnet; a trigger sensing mechanism configured to generate a voltage in response to the trigger mechanism displacing a detent mechanism and the magnet being within a threshold distance of the trigger sensing mechanism; and a fire control manager configured to: identify a trigger break based on the trigger sensing mechanism generating the voltage; and transmit a signal to an actuator mechanism, wherein the actuator mechanism is displaced in response to the transmitting the signal, and the displacing the actuator mechanism results in a projectile being propelled through the rifled barrel.

In some examples, the systems and techniques described herein relate to a gun, wherein the trigger sensing mechanism includes a Hall effect sensor, an optical interrupt sensor, or a physical switch.

In some examples, the systems and techniques described herein relate to a gun, wherein the trigger mechanism includes a second magnet, and the Hall effect sensor is configured to generate the voltage based on the magnet and the second magnet.

In some examples, the systems and techniques described herein relate to a gun, wherein the trigger sensing mechanism includes a second Hall effect sensor, and the second Hall effect sensor is configured to generate the voltage based on the magnet.

In some examples, the systems and techniques described herein relate to a gun, wherein the fire control manager is configured to identify the trigger break based on time-window filtering.

In some examples, the systems and techniques described herein relate to a gun, wherein the fire control manager is configured to identify the trigger break based on an edge-triggered flip-flop.

In some examples, the systems and techniques described herein relate to a system for generating trigger feel at a gun, including: a detent mechanism located in a displacement path of a trigger bar; a trigger body coupled with the trigger bar, the trigger body configured to undergo three stages of travel, the three stages of travel including: a take up stage of travel, the take up stage of travel corresponding to trigger movement that displaces a spring associated with a rate of deflection; a wall stage of travel, the wall stage of travel corresponding to trigger movement that displaces a second spring associated with a second rate of deflection that is higher than the rate of deflection; and an overtravel stage of travel that occurs based on the trigger mechanism being displaced through the take up stage of travel and the wall stage of travel; wherein the trigger body undergoes the three stages of travel based on the trigger bar displacing the detent mechanism while traveling along the displacement path. The take up stage of travel may referred to as stage (i); the wall stage of travel may be referred to as stage (ii); and the overtravel stage of travel may be referred to as stage (iii).

In some examples, the systems and techniques described herein relate to a system for generating trigger feel at a gun, further including: a trigger reset spring positioned such that the trigger reset spring is in contact with the trigger body, the trigger body configured to undergo a fourth stage of travel based on the trigger reset spring, wherein the fourth stage of travel corresponds to a reset stage.

In some examples, the systems and techniques described herein relate to a system for generating trigger feel at a gun, wherein the trigger body travels in a first direction during the three stages of travel, and the trigger body traveling in a second direction that is substantially opposite the first direction during the fourth stage of travel.

In some examples, the systems and techniques described herein relate to a method for firing a projectile from a gun that includes a fire control manager, the method including: method for firing a projectile from a gun that includes a fire control manager, the method comprising: identifying, by the fire control manager, movement of a trigger mechanism based on an analysis of a first signal output by a trigger sensing mechanism that is located proximate to the trigger mechanism, determining, by the fire control manager, that the movement satisfies a threshold, and transmitting, by the fire control manager in response to said determining, a second signal to an actuator mechanism, so as to cause displacement of the actuator mechanism that results in the projectile being fired from the gun.

Remarks

The Detailed Description provided herein, in connection with the appended figures (or drawings), describes example configurations and does not represent all the examples that may be implemented or that are within the scope of the claims. The term "example" used herein means "serving as an illustration or instance," and not "a preferred example."

The functions described herein may be implemented with a controller. A controller may include a manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

A claim is not intended to invoke means-plus-function interpretation (or step-plus-function interpretation) unless the claim uses the phrase "means for" together with an associated function. When a means-plus-function interpretation does apply to a clause in a claim, the given clause is intended to cover the structures describe herein as performing the associated function, including both structural equivalents that operate in the same manner, and equivalent structures that provide the same function.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A gun comprising:
a rifled barrel;
a trigger assembly comprising:
a trigger,
a magnet, and
a detent mechanism that is displaceable in response to force being applied thereto;
a trigger sensor configured to generate a voltage in response to displacement of the detent mechanism and the magnet moving to within a threshold distance of the trigger sensor; and
a fire control manager configured to:
identify a trigger break based on the trigger sensor contacting the detent mechanism and generating the voltage, and
transmit a signal to an actuator mechanism, wherein the actuator mechanism is displaced in response to the transmitting the signal, so as to cause displacement of the actuator mechanism that results in a projectile being propelled through the rifled barrel.

2. The gun of claim 1, wherein the trigger sensor comprises a Hall effect sensor, an optical interrupt sensor, or a physical switch.

3. The gun of claim 2, wherein the trigger comprises a second magnet, and the Hall effect sensor is configured to generate the voltage based on the magnet and the second magnet.

4. The gun of claim 2, wherein the trigger sensor comprises a second Hall effect sensor, and the second Hall effect sensor is configured to generate the voltage based on the magnet.

5. The gun of claim 1, wherein the fire control manager is further configured to identify the trigger break based on time-window filtering.

6. The gun of claim 1, wherein the fire control manager is further configured to identify the trigger break based on an edge-triggered flip-flop.

7. The gun of claim 1, wherein the detent mechanism is positioned in a displacement path of the trigger such that pulling the trigger results in the trigger contacting the detent mechanism.

8. The gun of claim 1, wherein the detent mechanism comprises a spring mechanism.

9. The gun of claim 1, wherein the detent mechanism comprises a spring mechanism positioned in a displacement path of the trigger such that pulling the trigger results in the trigger contacting the detent mechanism.

10. The gun of claim 1, wherein the fire control manager is further configured to identify the trigger break based on a trigger bar of the trigger contacting the detent mechanism.

11. The gun of claim 1, wherein the fire control manager is further configured to identify the trigger break based on a trigger body of the trigger contacting the detent mechanism.

12. The gun of claim 1, wherein the actuator mechanism comprises a solenoid that is configured to receive the signal and cause the displacement of the actuator mechanism.

13. The gun of claim 1, wherein the actuator mechanism comprises a piezo electric that is configured to receive the signal and cause the displacement of the actuator mechanism.

* * * * *